US011518653B2

(12) United States Patent
De Ledebur et al.

(10) Patent No.: US 11,518,653 B2
(45) Date of Patent: Dec. 6, 2022

(54) FOLDABLE ELEVATOR STRUCTURE

(71) Applicants: Juan-Carlos G. De Ledebur, Key Biscayne, FL (US); Stefan A. Gruber, Miami, FL (US); Patrick-Andrew G. De Ledebur, Miami, FL (US)

(72) Inventors: Juan-Carlos G. De Ledebur, Key Biscayne, FL (US); Stefan A. Gruber, Miami, FL (US); Patrick-Andrew G. De Ledebur, Miami, FL (US)

( * ) Notice: Subject to any disclaimer, the term of this patent is extended or adjusted under 35 U.S.C. 154(b) by 0 days.

(21) Appl. No.: 17/504,219

(22) Filed: Oct. 18, 2021

(65) Prior Publication Data

US 2022/0324678 A1 Oct. 13, 2022

Related U.S. Application Data

(63) Continuation-in-part of application No. 17/226,711, filed on Apr. 9, 2021.

(51) Int. Cl.

| | |
|---|---|
| ***B66B 11/02*** | (2006.01) |
| ***B66B 11/00*** | (2006.01) |
| ***B66B 19/00*** | (2006.01) |

(52) U.S. Cl.

CPC ..... *B66B 11/0005* (2013.01); *B66B 11/0206* (2013.01); *B66B 19/00* (2013.01)

(58) Field of Classification Search

CPC ..... B66B 11/02; B66B 11/0206; E04H 15/44; E04H 15/48; E04B 1/34357

See application file for complete search history.

(56) References Cited

U.S. PATENT DOCUMENTS

| | | | | |
|---|---|---|---|---|
| 6,035,877 | A * | 3/2000 | Losi, Jr. | E04H 15/322 135/141 |
| 6,772,458 | B2 * | 8/2004 | Ellen | A47C 21/08 5/98.1 |
| 8,650,678 | B2 * | 2/2014 | Thorne | A47D 13/061 5/98.1 |
| 11,193,300 | B2 * | 12/2021 | Thomas | E04H 15/48 |
| 2008/0087313 | A1 * | 4/2008 | Jang | E04H 15/50 135/145 |
| 2017/0280892 | A1 * | 10/2017 | Zhang | A47D 13/063 |

FOREIGN PATENT DOCUMENTS

| | | | | |
|---|---|---|---|---|
| CN | 112520543 | A * | 3/2021 | B66B 11/0206 |
| EP | 3031764 | A1 * | 6/2016 | B66B 11/0206 |

* cited by examiner

*Primary Examiner* — Minh Truong

(74) *Attorney, Agent, or Firm* — Patent CEO, LLC; Phillip Vales

(57) ABSTRACT

A foldable elevator structure having a plurality of members is shown having each current member sequentially attached between a preceding member and a succeeding member. This connection schema continues until the last member is attached to the first member and a completed enclosed structure is formed such that all members have been attached. In this fashion, the foldable structure is foldable between each set of two adjacent members.

21 Claims, 18 Drawing Sheets

OPEN POSITION

HALF OPEN POSITION

CLOSED POSITION

FOLDABLE ELEVATOR STRUCTURE

FIELD OF THE INVENTION

The present invention relates to elevators; more particularly, the present invention relates to devices that form a foldable structure for pneumatic, magnetic, counter-balancing weight and other types of elevators.

BACKGROUND OF THE INVENTION

Elevators typically use countervailing weights in order to facilitate a passenger cabin moving up and down an elevator shaft in large office buildings, hospitals, factories and similar structures. These types of elevators require a great deal of space, maintenance, equipment and machinery. More recently, a new type of elevator has been developed known as a vacuum elevator system. This elevator uses air pressure to cause the motion of the cabin within a thoroughfare or tubular cylinder that uses the air within it as a working fluid upon the confines of the cabin. Brakes, motors, valves, electronic controls and other equipment work in concert to ensure a safe and pleasant riding experience for each occupant therein.

However, during setup even the vacuum elevator system requires personnel to expend a great deal of time, effort and know how on site in the construction of the basic structures of an elevator system. Other types of elevator systems such as the ubiquitous counter-weight system requires even more time to setup the basic structures required before machinery, electronics, cabling and other types of components can be installed. All of this slows down the time until a user can get utility from his or her elevator. Additionally, it increases cost as personnel are deployed for construction and any and all tools, parts, machinery, power supplies and so forth must be deployed concurrently with the initial procedures.

Accordingly, there needs to be some solutions to overcome the aforementioned problems.

SUMMARY OF THE INVENTION

The present invention overcomes the deficiencies of the known art and the problems that remain unsolved by providing as described herein and in the accompanying drawings.

A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot; such that a third arm is movably attached to the first member and movably attached to a second pivot and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another which thereby facilitates a general shape of a square foldable frame structure;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another which thereby facilitates the general shape of the square foldable frame structure;

a fourth member movably attached to the third member through a fifth pivot such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another which thereby facilitates the general shape of the square foldable frame structure;

the fourth member movably attached to the first member through a seventh pivot; such that a thirteenth arm is movably attached to the fourth member and movably attached to the seventh pivot; and such that a fourteenth arm is movably attached to the first member and movably attached to the seventh pivot;

wherein the fourth member is movably attached to the first member through an eighth pivot; such that an fifteenth arm is movably attached to the fourth member and movably attached to the eighth pivot; and such that a sixteenth arm is movably attached to the first member and movably attached to the eight pivot;

wherein the fourth member has a seventh surface forming a seventh space for attaching the thirteenth arm thereto and the first member has an eighth surface forming an eighth space for attaching the fourteenth arm thereto, such that the spatial locations of these spaces are generally disposed at an angle to one another which thereby facilitates the general shape of the square foldable frame structure;

wherein the first, second, third and fourth member further each comprise: a forward protrusion and a rear edge lying on a centerline of the first member and on opposing sides thereof; a left back portion integrates along the rear edge with a right back portion; a first left angled portion integrates along a first common edge with the left back portion and moves closer to the centerline as it approaches the forward protrusion; the first left angled portion also integrates along its second edge common with a second left angled portion that moves away from the centerline and away from the forward protrusion; the second left angled portion has another edge in common with a left front surface; this left front surface moves towards the centerline and integrally curves into the forward protrusion;

this forward protrusion has a right front surface that curves away from it and away from the centerline; the right front surface integrates along a third common edge with a second right angled portion that angles towards the centerline and away from the forward protrusion; the second right angled portion has a fourth common edge with a first right angled portion that moves away from the centerline and away from the forward protrusion; the first right angled portion has a fifth common edge with the right back portion.

A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot; such that a third arm is movably attached to the first member and movably attached to a second pivot and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another;

wherein the first member further comprises: a forward protrusion and a rear edge lying on a centerline of the first member and on opposing sides thereof; a left back portion integrates along the rear edge with a right back portion; a first left angled portion integrates along a first common edge with the left back portion and moves closer to the centerline as it approaches the forward protrusion; the first left angled portion also integrates along its second edge common with a second left angled portion that moves away from the centerline and away from the forward protrusion; the second left angled portion has another edge in common with a left front surface; this left front surface moves towards the centerline and integrally curves into the forward protrusion;

this forward protrusion has a right front surface that curves away from it and away from the centerline; the right front surface integrates along a third common edge with a second right angled portion that angles towards the centerline and away from the forward protrusion; the second right angled portion has a fourth common edge with a first right angled portion that moves away from the centerline and away from the forward protrusion; the first right angled portion has a fifth common edge with the right back portion.

A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot such that a third arm is movably attached to the first member and movably attached to a second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

wherein the first and second members each further comprise: a forward protrusion and a rear edge lying on a centerline of the first member and on opposing sides thereof; a left back portion integrates along the rear edge with a right back portion; a first left angled portion integrates along a first common edge with the left back portion and moves closer to the centerline as it approaches the forward protrusion; the first left angled portion also integrates along its second edge common with a second left angled portion that moves away from the centerline and away from the forward protrusion; the second left angled portion has another edge in common with a left front surface; this left front surface moves towards the centerline and integrally curves into the forward protrusion;

this forward protrusion has a right front surface that curves away from it and away from the centerline; the right front surface integrates along a third common edge with a second right angled portion that angles towards the centerline and away from the forward protrusion; the second right angled portion has a fourth common edge with a first right angled portion that moves away from the centerline and away from the forward protrusion; the first right angled portion has a fifth common edge with the right back portion.

A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot; such that a third arm is movably attached to the first member and movably attached to a second pivot and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another which thereby facilitates a general shape of a square foldable frame structure;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another which thereby facilitates the general shape of the square foldable frame structure;

a fourth member movably attached to the third member through a fifth pivot such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another which thereby facilitates the general shape of the square foldable frame structure;

wherein the first, second and third members each further comprise: a forward protrusion and a rear edge lying on a centerline of the first member and on opposing sides thereof; a left back portion integrates along the rear edge with a right back portion; a first left angled portion integrates along a first common edge with the left back portion and moves closer to the centerline as it approaches the forward protrusion; the first left angled portion also integrates along its second edge common with a second left angled portion that moves away from the centerline and away from the forward protrusion; the second left angled portion has another edge in common with a left front surface; this left front surface moves towards the centerline and integrally curves into the forward protrusion;

this forward protrusion has a right front surface that curves away from it and away from the centerline; the right front surface integrates along a third common edge with a second right angled portion that angles towards the centerline and away from the forward protrusion; the second right angled portion has a fourth common edge with a first right angled portion that moves away from the centerline and away from the forward protrusion; the first right angled portion has a fifth common edge with the right back portion.

A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to the fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot; such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

the fourth member movably attached to the first member through a seventh pivot such that a thirteenth arm is movably attached to the fourth member and movably attached to the seventh pivot; and such that a fourteenth arm is movably attached to the first member and movably attached to the seventh pivot;

wherein the fourth member is movably attached to the first member through an eighth pivot; such that a fifteenth arm is movably attached to the fourth member and movably attached to the eighth pivot; and such that a sixteenth arm is movably attached to the first member and movably attached to the eight pivot;

wherein the fourth member has a seventh surface forming a seventh space for attaching the thirteenth arm thereto and the first member has an eighth surface forming an eighth space for attaching the fourteenth arm thereto, such that the spatial locations of these spaces are generally disposed at an angle to one another which thereby facilitates a general shape of the circular foldable frame structure;

wherein the first, second, third and fourth members each comprise: a back portion opposite a protrusion that is disposed away from a center of the respective member; wherein the back portion integrates along a first common edge with a right portion; the right portion integrates with a right flanged portion; this right flanged portion moves away from the protrusion and the center of the respective member and also integrally serves as a rightmost part of a right front portion;

the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

wherein the first member comprises: a back portion opposite a protrusion that is disposed away from a center of the respective member; wherein the back portion integrates along a first common edge with a right portion; the right portion integrates with a right flanged portion; this right flanged portion moves away from the protrusion and the center of the respective member and also integrally serves as a rightmost part of a right front portion;

the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot such that a seventh arm is movably attached to the second member and movably attached to the fourth pivot and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

wherein the first and second members each comprise: a back portion opposite a protrusion that is disposed away from a center of the respective member; wherein the back portion integrates along a first common edge with a right portion; the right portion integrates with a right flanged portion; this right flanged portion moves away from the protrusion and the center of the respective member and also integrally serves as a rightmost part of a right front portion;

the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to the fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot; such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

wherein the first, second and third members each comprise: a back portion opposite a protrusion that is disposed away from a center of the respective member; wherein the back portion integrates along a first common edge with a right portion; the right portion integrates with a right flanged portion; this right flanged portion moves away from the protrusion and the center of the respective member and also integrally serves as a rightmost part of a right front portion;

the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another which thereby facilitates a general shape of an octagonal foldable frame structure;

a third member movably attached to the second member through a third pivot; such that a fifth arm is movably attached to the second member and movably attached to the third pivot and such that a sixth arm is movably attached to the third member and movably attached to the third pivot;

wherein the third member is movably attached to the second member through a fourth pivot such that a seventh arm is movably attached to the second member and movably attached to a fourth pivot and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another which thereby facilitates the general shape of the octagonal foldable frame structure;

a fourth member movably attached to the third member through a fifth pivot; such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another which thereby facilitates the general shape of the octagonal foldable frame structure;

the fourth member movably attached to the first member through a seventh pivot; such that a thirteenth arm is movably attached to the fourth member and movably attached to the seventh pivot and such that a fourteenth arm is movably attached to the first member and movably attached to the seventh pivot;

wherein the fourth member is movably attached to the first member through an eighth pivot; such that a fifteenth arm is movably attached to the fourth member and movably attached to the eighth pivot and such that a sixteenth arm is movably attached to the first member and movably attached to the eight pivot;

wherein the fourth member has a seventh surface forming a seventh space for attaching the thirteenth arm thereto and the first member has an eighth surface forming an eighth space for attaching the fourteenth arm thereto, such that the spatial locations of these spaces are generally disposed at an angle to one another which thereby facilitates the general shape of the octagonal foldable frame structure; wherein the first, second, third and fourth members each further comprise:

a cross section centerline of the first, second, third and fourth members each has a protrusion opposite a common edge from a center thereof; a left back portion integrates along the common edge with a right back portion; the right back portion integrates with a first right angled portion; this moves closer to the centerline in the direction of the protrusion and integrates along a second common edge with a second right angled portion that moves away from the centerline and the protrusion;

the second right angled portion integrates at another edge in common with the right front portion; the right front portion ends in a curve in common with a protrusion; the protrusion integrates along another common curve with a left front surface; the left front surface has a third common edge with a second left angled portion that approaches the centerline ending at a fourth common edge with the first left angled portion; the first left angled portion moves away from the centerline and protrusion integrating with the left back surface along a fifth common edge.

A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another; wherein the first pivot further comprises:

a flat bottom and a flat top surface as well as a left protrusion and a right protrusion situated at an angle there between at opposing ends;

a rear surface has a triangular or arrow head shape with a top of the triangular or arrow head shape disposed outwards from a center of the first pivot and integrating along an edge with; the rear surface integrates with a small flat surface along a common edge; this small flat surface then integrates with an edge of a first protrusion; this first protrusion has a hole passing there through for attachment of the first arm;

another edge of the first protrusion integrates with another small flat surface that in turn integrates with an edge of a small inwardly directed towards the center of the first pivot three faceted shape; these three facets are to follow the general direction which is an inward arrow head or triangular shape of the rear surface; another edge of the three faceted shape integrates with a small flat surface that itself integrates with an edge of a second protrusion; this second protrusion has a hole passing there through for attachment of the second arm; another edge of the second protrusion integrates with another small flat surface that returns to integrate with an edge of rear surface.

A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another; wherein the first and second members each further comprise:

a cross section centerline of the first, second, third and fourth members each has a protrusion opposite a common edge from a center thereof; a left back portion integrates along the common edge with a right back portion; the right back portion integrates with a first right angled portion; this moves closer to the centerline in the direction of the protrusion and integrates along a second common edge with a second right angled portion that moves away from the centerline and the protrusion;

the second right angled portion integrates at another edge in common with the right front portion; the right front portion ends in a curve in common with a protrusion; the protrusion integrates along another common curve with a left front surface; the left front surface has a third common edge with a second left angled portion that approaches the centerline ending at a fourth common edge with the first left angled portion; the first left angled portion moves away from the centerline and protrusion integrating with the left back surface along a fifth common edge.

A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another which thereby facilitates a general shape of an octagonal foldable frame structure;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another; wherein the first, second, and third members each further comprise:

a cross section centerline of the first, second, third and fourth members each has a protrusion opposite a common edge from a center thereof; a left back portion integrates along the common edge with a right back portion; the right back portion integrates with a first right angled portion; this moves closer to the centerline in the direction of the protrusion and integrates along a second common edge with a second right angled portion that moves away from the centerline and the protrusion;

the second right angled portion integrates at another edge in common with the right front portion; the right front portion ends in a curve in common with a protrusion; the protrusion integrates along another common curve with a left front surface; the left front surface has a third common edge with a second left angled portion that approaches the centerline ending at a fourth common edge with the first left angled portion; the first left angled portion moves away from the centerline and protrusion integrating with the left back surface along a fifth common edge.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A foldable elevator structure designed for easy setup and deployment are disclosed herein; a foldable elevator structure having a plurality of members is shown having each current member sequentially attached between a preceding member and a succeeding member until all members have been attached. In this fashion, the foldable structure is foldable between each set of two adjacent members.

Figure 36A:
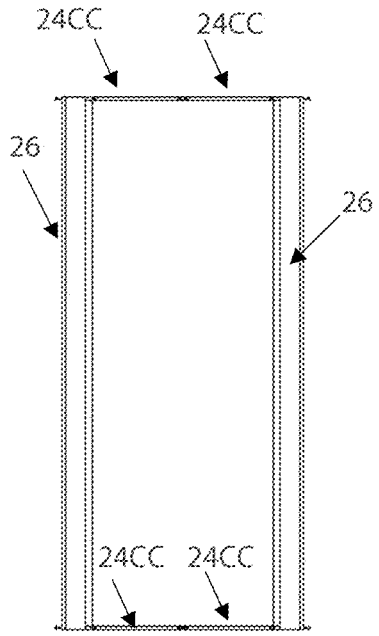
FIG. 36A presents a front view of a foldable shaft structure in a first embodiment taught herein.

FIG. 36A presents a front view of a foldable shaft structure in a first embodiment taught herein. Members 26 are connected together at top and bottom with various pairs of arms 24CC as more fully described below.

Figure 36B:
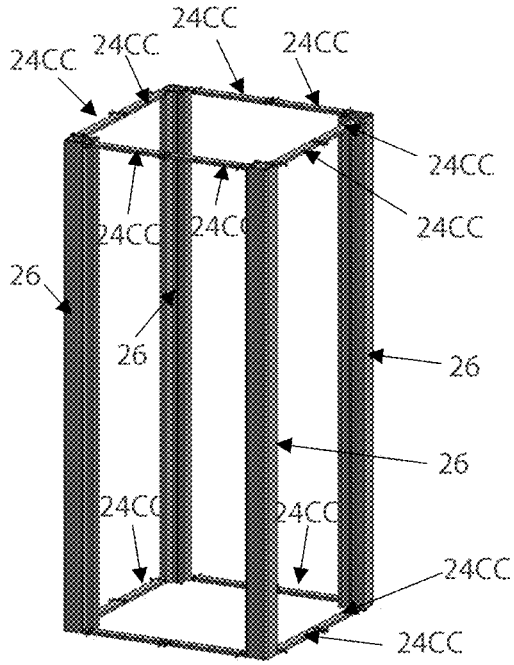
FIG. 36B presents an isometric view of a foldable shaft structure in a first embodiment taught herein.

FIG. 36B presents an isometric view of a foldable shaft structure in a first embodiment taught herein. Four members 26 each have a top and a bottom portion and are disposed vertically; they are connected together with various arms 24CC wherein each arm 24CC has two ends. A first member 26 and a second member 26 are connected together with two pairs of arms 24CC. A first arm 24CC in a pair of arms 24CC is connected to the second arm in the pair at a first end of the first arm 24CC together with a first end of the second arm 24CC in the pair; the second end of a first arm 24CC of the pair of arms 24CC is connected to a first member 26 at the top portion thereof while the second end of the second arm 24CC is connected to a second member 26 at the top portion thereof. Another pair of arms 24CC is likewise attached together and to the bottom portion of the first member 26 and the bottom portion of the second member 26.

It should then be understood that the top and bottom portions of the first member 26 are similarly attached to the top and bottom portions of a fourth member 26. Likewise, the top and bottom portions of the second member 26 are attached to the top and bottom portions of a third member 26. Finally, the third member 26 and the fourth member 26 are similarly attached together at the top and bottom portions of the third member and the top and bottom portions of the fourth member.

Figure 37A:
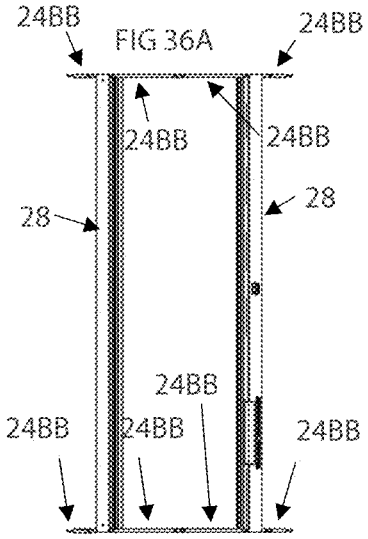
FIG. 37A presents a front view of a foldable shaft structure in a second embodiment taught herein.

FIG. 37A presents a front view of a foldable shaft structure in a second embodiment taught herein. Members 28 are connected together at top and bottom with various pairs of arms 24BB as more fully described below.

Figure 37B:
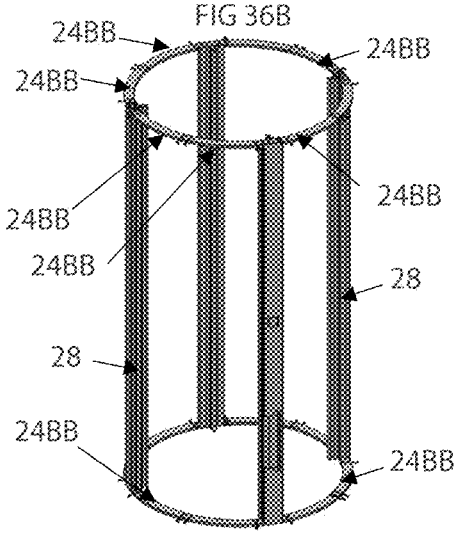
FIG. 37B presents an isometric view of a foldable shaft structure in a second embodiment taught herein.

FIG. 37B presents an isometric view of a foldable shaft cabin structure in a second embodiment taught herein. Four members 28 each have a top and a bottom portion and are disposed vertically and are connected together with various arms 24BB where each arm 24BB has two ends. A first member 28 and a second member 28 are connected with two pairs of arms 24BB. A first arm 24BB in a pair of arms 24BB are connected to the second arm in a pair of arms 24BB at a first end of the first arm 24BB in the pair together with the first end of the second arm 24BB in the pair of arms 24BB; the second end of a first arm 24BB of a pair of arms 24BB is connected to a first member 28 at the top portion thereof while the second end of the second arm 24BB is connected to the second member 28 at the top portion thereof. Another pair of arms 24BB is likewise attached together and to the bottom portion of the first member 28 and the bottom portion of the second member 28.

It should then be understood that the top and bottom portions of the first member 28 are similarly attached to the top and bottom portions of a fourth member 28. Likewise, the top and bottom portions of the second member 28 are attached to the top and bottom portions of a third member 28. Finally, the third member 28 and the fourth member 28 are attached together at the top and bottom portions of the third member and at the top and bottom portions of the fourth member.

Figure 38A:
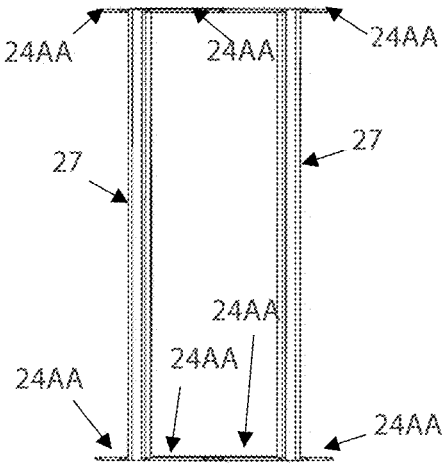
FIG. 38A presents a front view of a foldable shaft structure in a third embodiment taught herein.

FIG. 38A presents a front view of a foldable shaft structure in a third embodiment taught herein. Members 28 are connected together at top and bottom with various pairs of arms 24AA as more fully described below.

Figure 38B:
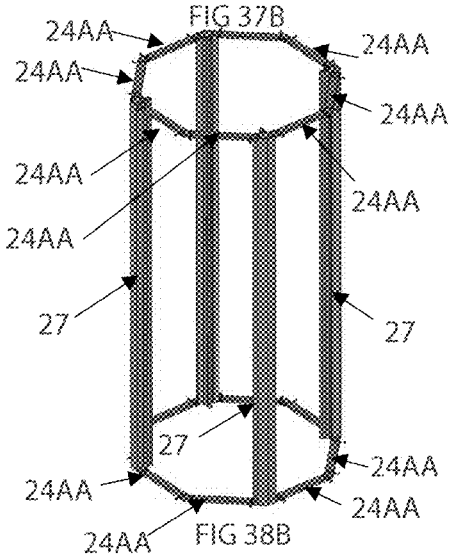
FIG. 38B presents an isometric view of a foldable shaft structure in a third embodiment taught herein.

FIG. 38B presents an isometric view of a foldable shaft cabin structure in a third embodiment taught herein. Four members 27 each have a top and a bottom portion and are disposed vertically and are connected together with various arms 24AA where each arm 24AA has two ends. A first member 27 and a second member 27 are connected with two pairs of arms 24AA. The first arm 24AA in a pair of arms 24AA is connected at a first end of the first arm 24AA together with a first end of the second arm 24AA; the second end of the first arm 24AA of a pair of arms 24AA is connected to a first member 27 at the top portion thereof while the second end of the second arm 24AA is connected to a second member 27 at the top portion thereof. Another pair of arms 24AA is likewise attached together and to the bottom portion of the first member 27 and the bottom portion of the second member 27.

It should then be understood that the top and bottom portions of the first member 27 are similarly attached to the top and bottom portions of a fourth member 27. Likewise, the top and bottom portions of the second member 27 are attached to the top and bottom portions of a third member 27. Finally, the third member 27 and the fourth member 27 are attached together at the top and bottom portions of the third member and the top and bottom portions of the fourth member.

Figure 39A:
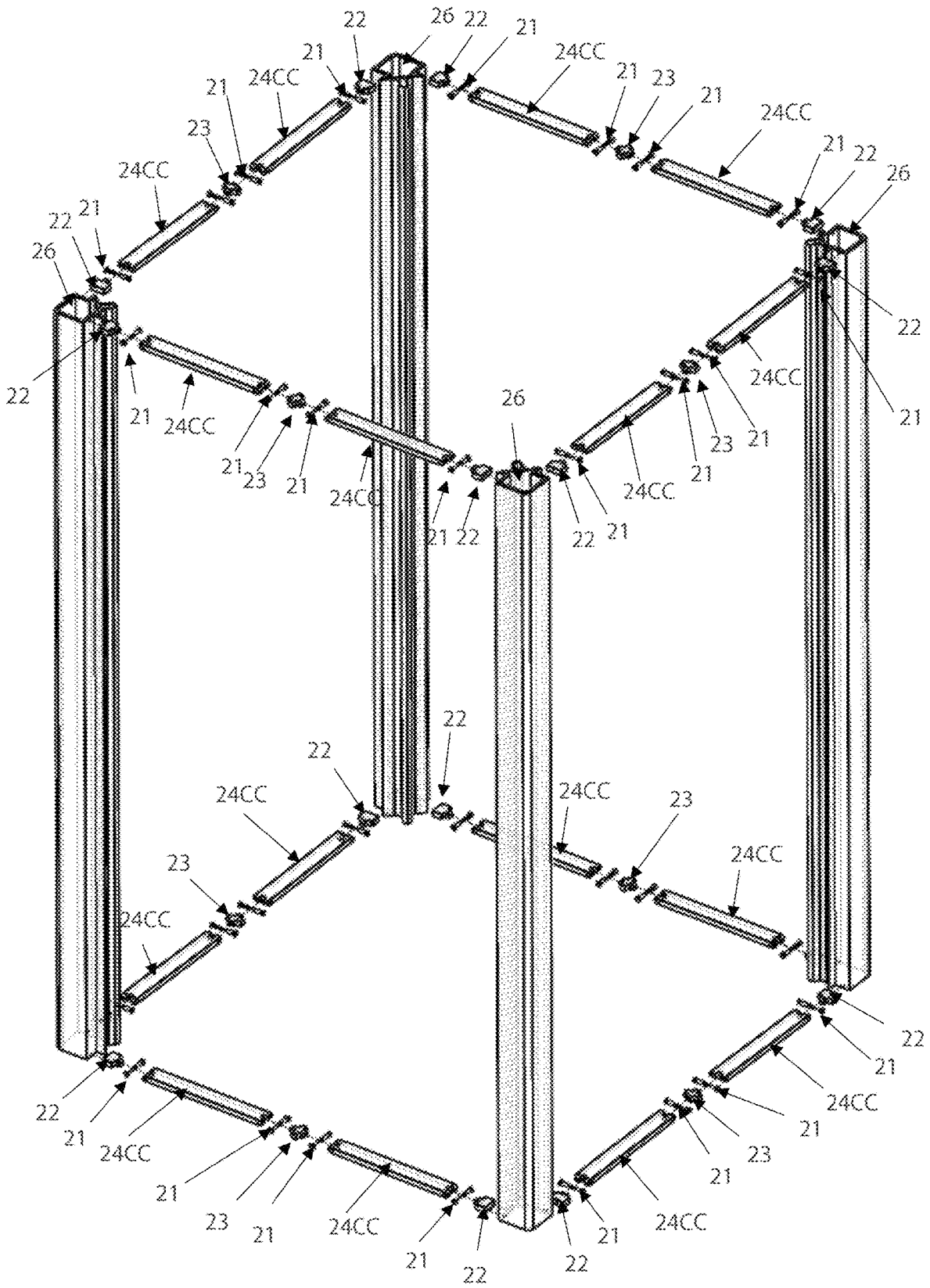
FIG. 39A presents an isometric assembly view of a foldable shaft structure in a first embodiment taught herein.

FIG. 39A presents an isometric assembly view of a foldable shaft structure in a first embodiment taught herein. Four members 26 arranged vertically are attached together forming a square shape by using pairs of arms 24CC. Each pair of arms 24CC is connected together at a first end of the first arm 24CC and at a first end of the second arm 24CC using a pivot 23. A barrel and screw 21 fastener connects the pivot 23 to the first arm 24CC through dual holes (otherwise known as an attachment point) in the first arm 24CC first end and a first corresponding hole in the pivot 23. Another barrel and screw 21 fastener connects the pivot 23 to the second arm 24CC first end through dual holes (otherwise known as an attachment point) in the second arm 24CC first end and a second corresponding hole in the pivot 23.

The connection of the second end of the first arm 24CC is to a top portion of a first member 26 whilst the second end of the second arm 24CC is to a top portion of a second member 26. It should be understood that each member 26 has a top portion and a bottom portion that facilitate attachment of the arms 24CC. The top portion has a space for welded attachment of a support 22 and another space for welded attachment of another support 22. The spatial locations of these spaces are generally disposed at an angle to one another that forms the rectangular foldable frame structure. Similarly disposed, each member 26 has a bottom portion having a space for welded attachment of a support 22 and another space for welded attachment of another support 22; these spatial locations are generally disposed at an angle to one another that forms the rectangular foldable frame structure.

Now we continue the attachment of the first arm 24CC to the first member top portion and a second arm 24CC to the second member top portion. A first support 22 is welded on a top portion of a first member 26; this support 22 has a hole therein for corresponding dual holes (otherwise known as an attachment point) in the second end of a first arm 24CC attached together with a screw and barrel 21 fastener. A second support 22 is welded on the top portion of a second member 26; this support 22 has a hole therein for a corresponding dual holes (otherwise known as an attachment point) in the second end of a second arm 24CC attached together with another screw and barrel 21 fastener set. It should be apparent as previously described, that the top and bottom portions of the four members 26 of the foldable shaft structure are likewise attached together by eight pairs of arms 24CC, 16 supports 22 with eight associated pivots 23 and thirty-two barrel and screw 21 fastener sets.

Figure 39B:
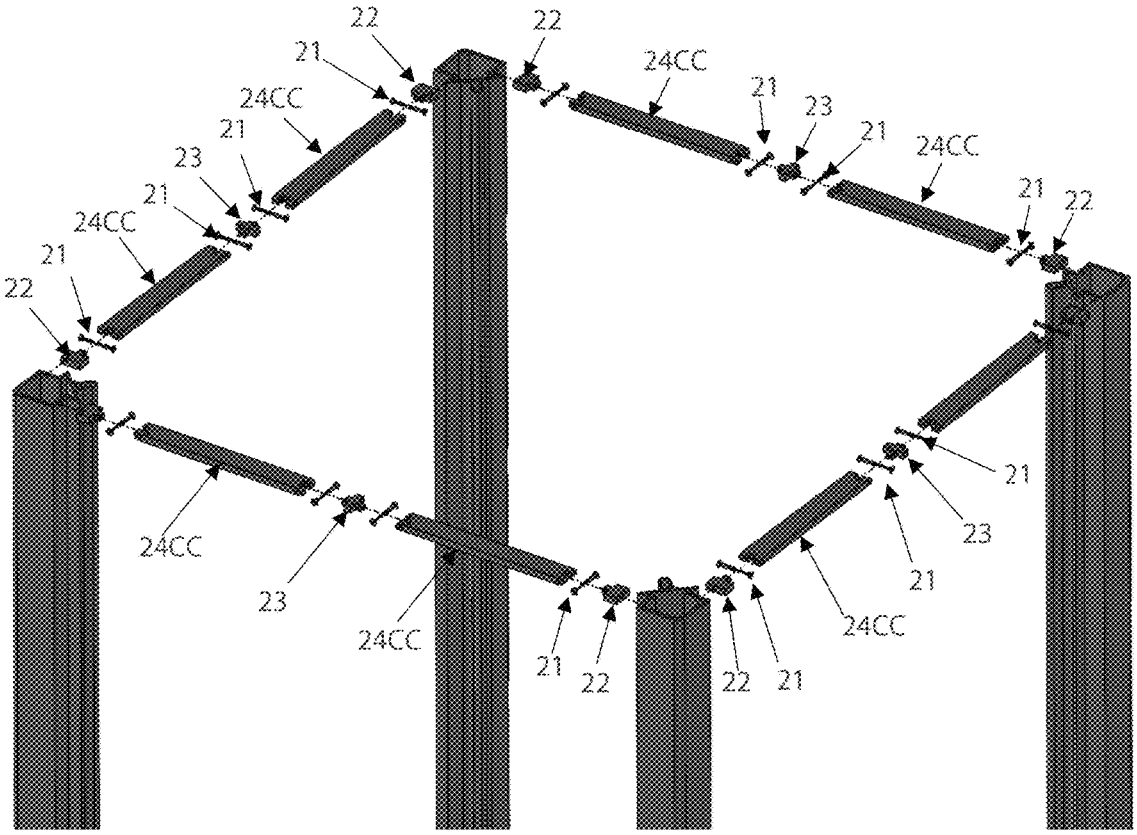
FIG. 39B presents a top isometric assembly view of a foldable shaft structure in a first embodiment taught herein.

FIG. 39B presents a top isometric assembly view of a foldable shaft structure in a first embodiment taught herein.

Figure 39C:
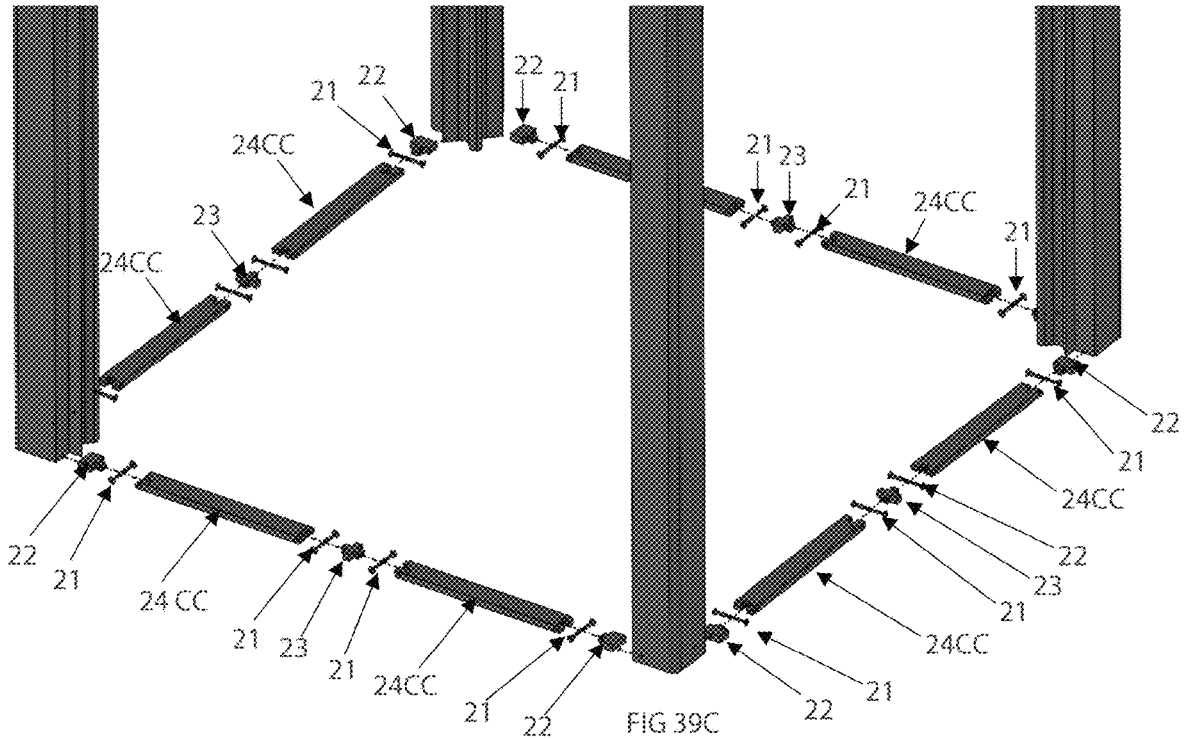
FIG. 39C presents a bottom isometric assembly view of a foldable shaft structure in a first embodiment taught herein.

FIG. 39C presents a bottom isometric assembly view of a foldable shaft structure in a first embodiment taught herein.

Figure 40A:
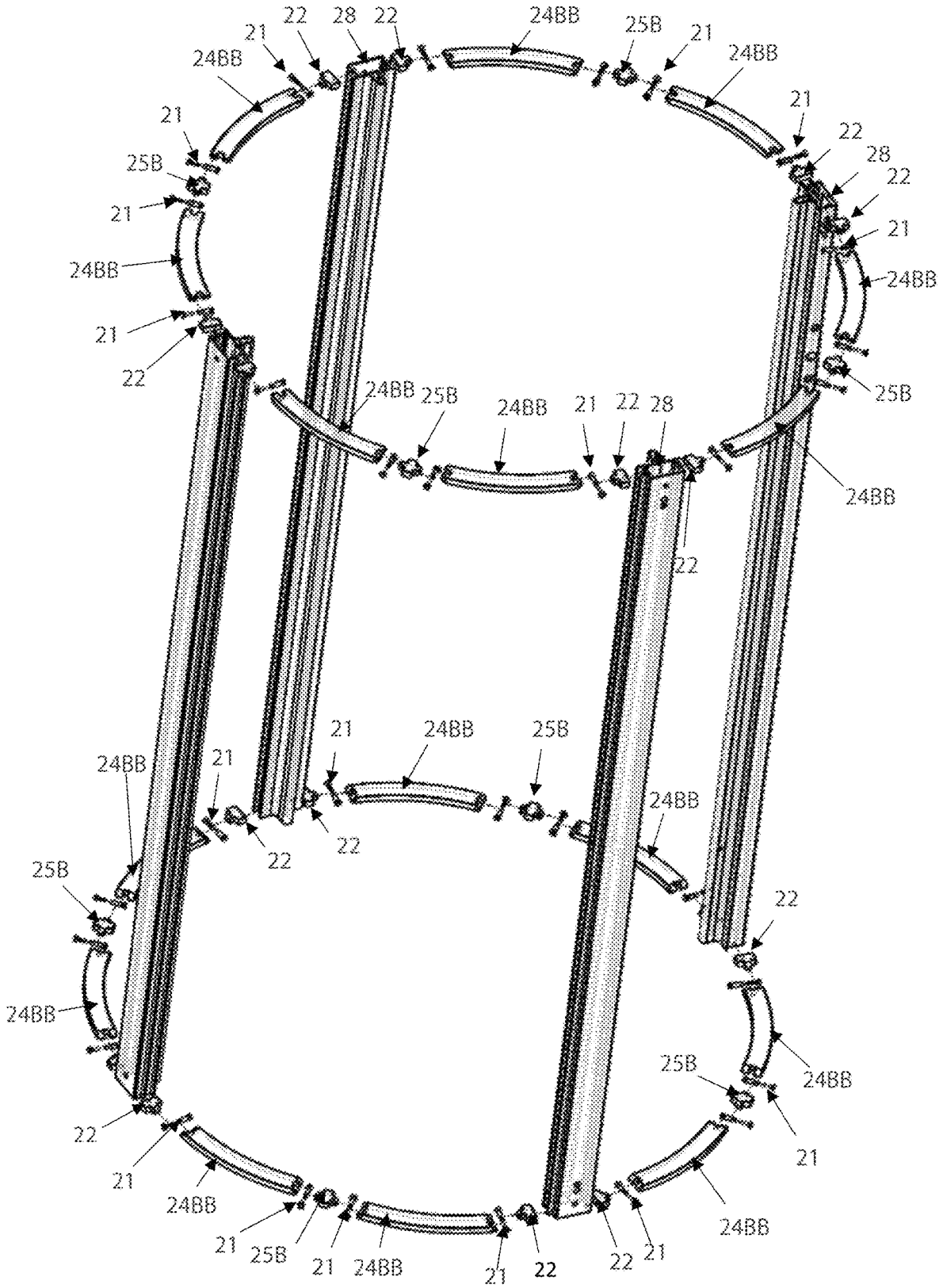
FIG. 40A presents an isometric assembly view of a foldable shaft structure in a second embodiment taught herein.

FIG. 40A presents an isometric assembly view of a foldable shaft structure in a second embodiment taught herein. Four members 28 are attached together forming a circular shape by using pairs of arms 24BB. Each pair of arms 24BB is connected together at a first end of the first arm 24BB and at a first end of the second arm 24BB using a pivot 25B. A barrel and screw 21 fastener connects the pivot 25B to the first arm 24BB first end through dual holes (otherwise known as an attachment point) in the first arm 24BB first end and a first corresponding hole in the pivot 25B. Another barrel and screw 21 fastener connects the pivot 25B to the second arm 24BB first end through dual holes (otherwise known as an attachment point) in the second arm 24BB first end and a second corresponding hole in the pivot 25B.

The connection of the second end of the first arm 24BB is to a top portion of a first member 28 whilst the second end of the second arm 24BB is to a top portion of a second member 28. It should be understood that each member 28 has a top portion and a bottom portion that facilitate attachment of the arms 24BB. The top portion has a space for welded attachment of a support 22 and another space for welded attachment of another support 22. The spatial locations of these spaces are generally disposed at an angle to one another that facilitates the formation of a circular foldable frame structure. Similarly disposed, each member 28 has a bottom portion having a space for welded attachment of a support 22 and another space for welded attachment of another support 22. The spatial locations of these spaces are generally disposed at an angle to one another that facilitates the formation of a circular foldable frame structure.

Now we continue the attachment of the first arm to the first member 28 top portion and a second arm to the second member 28 top portion. A first support 22 is welded on a top portion of a first member 28; this support 22 has a hole therein for concentric location with a corresponding dual hole (otherwise known as an attachment point) in the second end of a first arm 24BB attached together with a screw and barrel 21 fastener. A second support 22 is welded on the top portion of a second member 28; this support 22 has a hole therein for concentric location with a corresponding dual hole (otherwise known as an attachment point) in the second end of a second arm 24BB attached together with another screw and barrel 21 fastener set. It should be apparent as previously described, that the top and bottom portions of the four members 28 of the foldable shaft structure are likewise attached together by eight pairs of arms 24BB, 16 supports 22, eight associated pivots 25B and thirty two barrel and screw 21 fasteners.

Figure 40B:
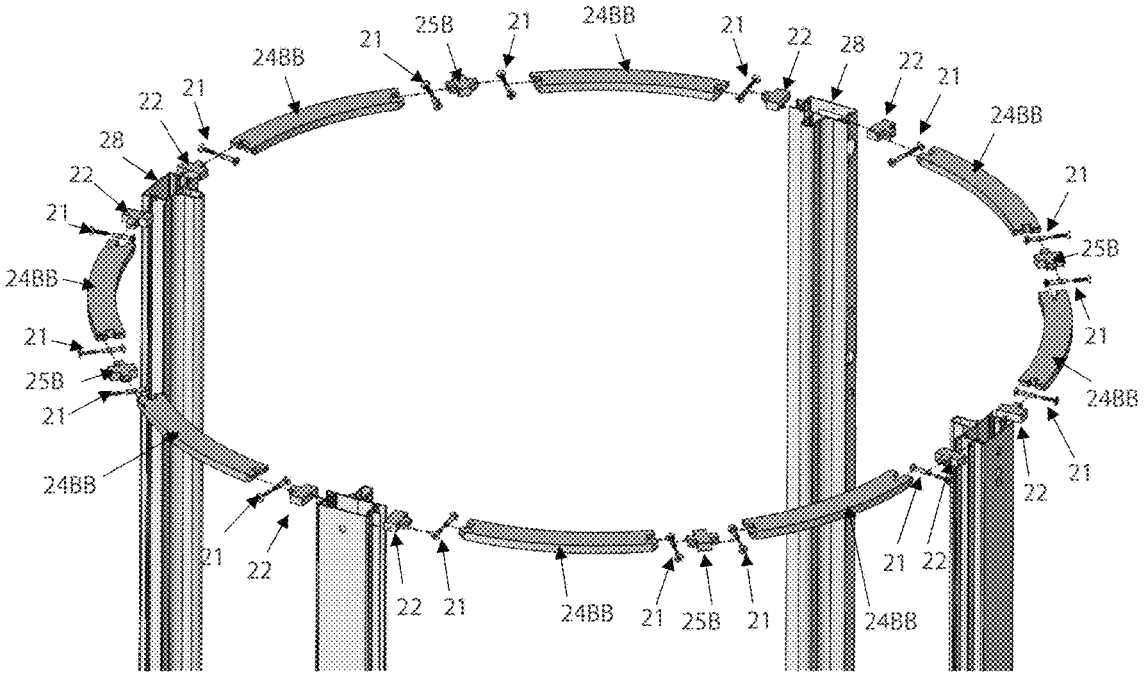
FIG. 40B presents a top isometric assembly view of a foldable shaft structure in a second embodiment taught herein.

FIG. 40B presents a top isometric assembly view of a foldable shaft structure in a second embodiment taught herein.

Figure 40C:
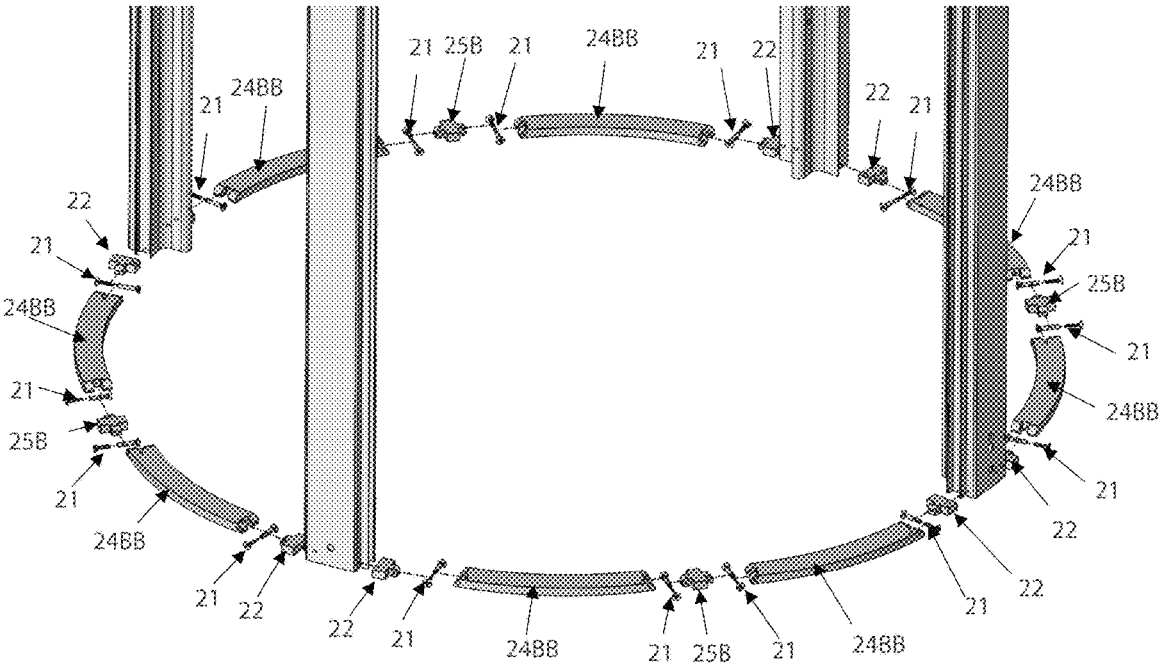
FIG. 40C presents a bottom isometric assembly view of a foldable shaft structure in a second embodiment taught herein.

FIG. 40C presents a bottom isometric assembly view of a foldable shaft structure in a second embodiment taught herein.

Figure 41A:
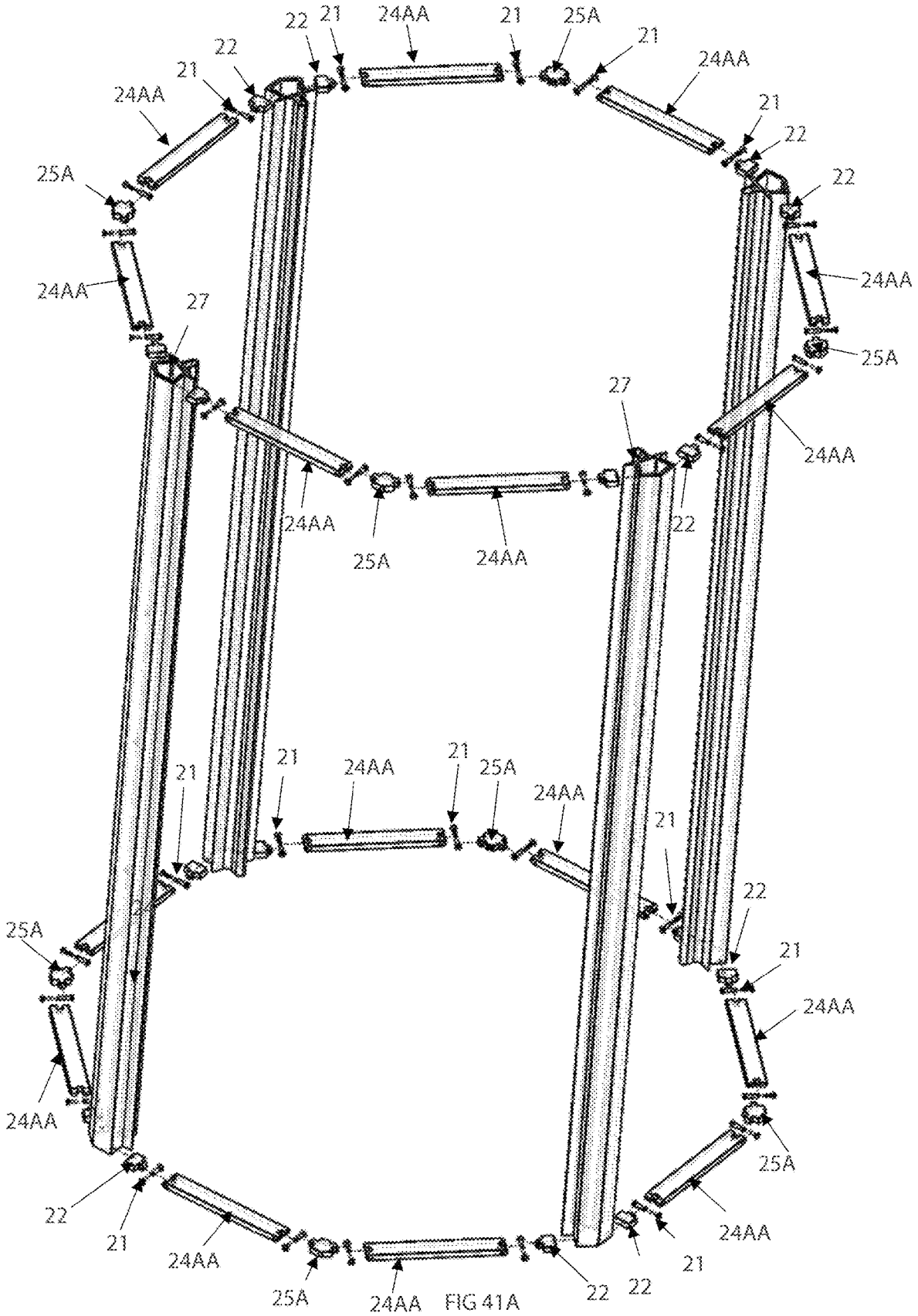
FIG. 41A presents an isometric assembly view of a foldable shaft structure in a third embodiment taught herein.

FIG. 41A presents an isometric assembly view of a foldable shaft structure in a third embodiment taught herein. Four members 27 are attached together forming an octagonal shape by using pairs of arms 24AA. Each pair of arms 24AA is connected together at a first end of the first arm 24 and at a first end of the second arm 24AA using a pivot 25A. A barrel and screw 21 fastener connects the pivot 25A to the first arm 24 through a dual hole (otherwise known as an attachment point) in the first arm 24AA first end and a concentrically located first corresponding hole in the pivot 25A. Another barrel and screw 21 fastener connects the pivot 25A to the second arm 24AA first end through a dual hole (otherwise known as an attachment point) in the second arm 24AA first end and a second concentrically located corresponding hole in the pivot 25A.

The connection of the second end of the first arm is to a top portion of a first member 27 whilst the second end of the second arm is to a top portion of a second member 27. It should be understood that each member 27 has a top portion and a bottom portion that facilitate attachment of the arms 24AA. The top portion has a space for welded attachment of a support 22 and another space for welded attachment of another support 22. The spatial locations of these support 22 spaces are generally disposed at an angle to one another that forms the octagonal foldable frame structure. Similarly disposed, each member 27 has a bottom portion having a space for welded attachment of a support 22 and another space for welded attachment of another support 22 thereby similarly facilitating the octagonal foldable frame structure. The spatial locations of these support 22 spaces are generally disposed at an angle to one another that forms the octagonal foldable frame structure.

Now we continue the attachment of the first arm to the first member top portion and a second arm to the second member top portion. A first support 22 is welded on a top portion of a first member 27; this support 22 has a hole therein concentric with a corresponding dual hole (otherwise known as an attachment point) in the second end of a first arm 24AA attached together with a screw and barrel 21 fastener. A second support 22 is welded on the top portion of a second member 27; this support 22 has a hole therein for a concentrically disposed corresponding dual hole (otherwise known as an attachment point) in the second end of a second arm 24AA attached together with another screw and barrel 21 fastener set. It should be apparent as previously described, that the top and bottom portions of the four members 27 of the foldable shaft structure are likewise attached together by eight pairs of arms 24AA, 16 associated supports 22, eight associated pivots 25A and thirty-two barrel and screw 21 fasteners.

Figure 41B:
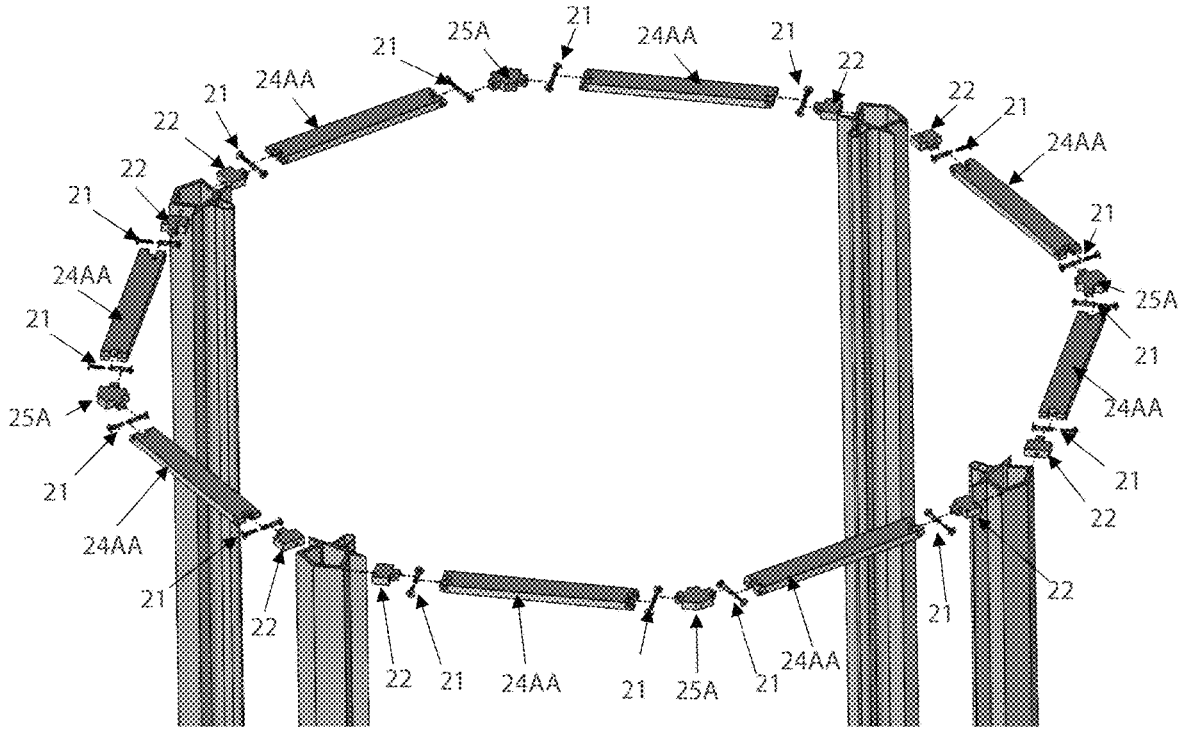
FIG. 41B presents a top isometric assembly view of a foldable shaft structure in a third embodiment taught herein.

FIG. 41B presents a top isometric assembly view of a foldable shaft structure in a third embodiment taught herein.

Figure 41C:
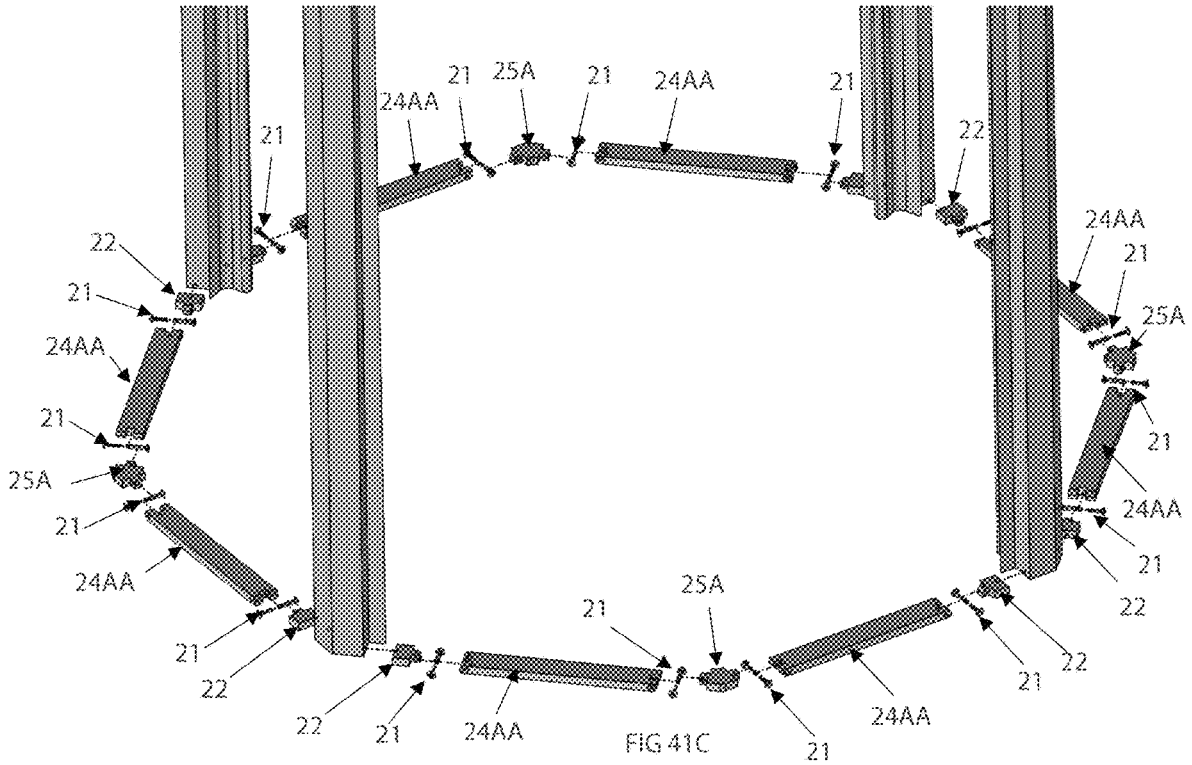
FIG. 41C presents a bottom isometric assembly view of a foldable shaft structure in a third embodiment taught herein.

FIG. 41C presents a bottom isometric assembly view of a foldable shaft structure in a third embodiment taught herein.

Figure 42A:
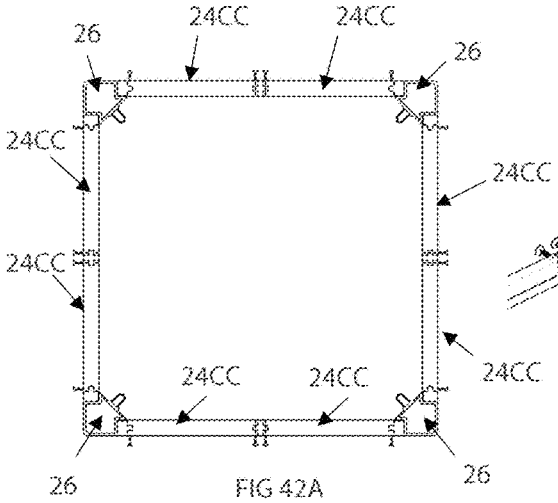
FIG. 42A presents a top view of a foldable shaft structure in a first embodiment disclosed herein.
Figure 42B:
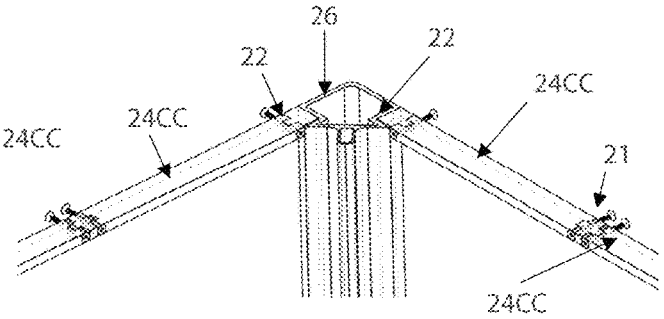
FIG. 42B presents a top isometric closeup view of a portion of a foldable shaft structure in a first embodiment disclosed herein.

FIG. 42A presents a top view of a foldable shaft structure in a first embodiment disclosed herein. Here are shown the top of four members 26 having two arms 24CC attached between each adjacent two members 26 such that only two arms are shown attached to each member 26. FIG. 42B presents a top isometric closeup view of a portion of a foldable shaft structure in a first embodiment disclosed herein. A second end of a first arm 24CC is attached using a dual hole therein with a corresponding hole in a support 22 that has been welded to a top portion of the member 26. Barrel and screw 21 fasteners attach the arm 24CC to a pivot 23 using a dual hole in the first end of the arm 24CC and a corresponding hole in the pivot 23; this is also similarly attached to a second arm 24CC first end using a separate hole in the pivot 23 and a corresponding dual hole in the second arm 24CC using another barrel and screw fastener 21. The second arm 24CC has its second end dual hole attached to a corresponding hole (using another barrel and screw fastener 21) in another support 22 which is welded to another member 26. This attachment process is repeated about the top and bottom of the foldable shaft structure thereby forming a square shape.

Figure 43A:
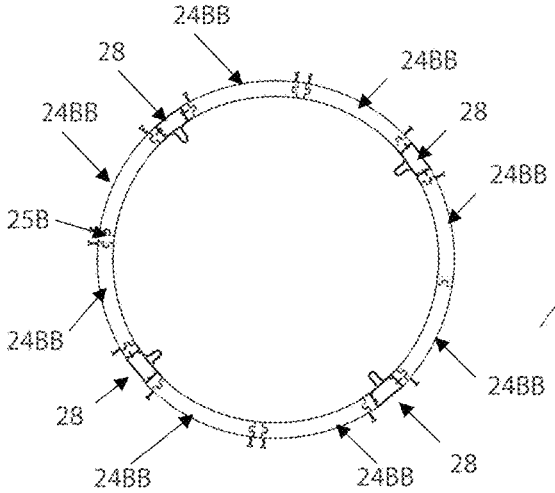
FIG. 43A presents a top view of a foldable shaft structure in a second embodiment disclosed herein.
Figure 43B:
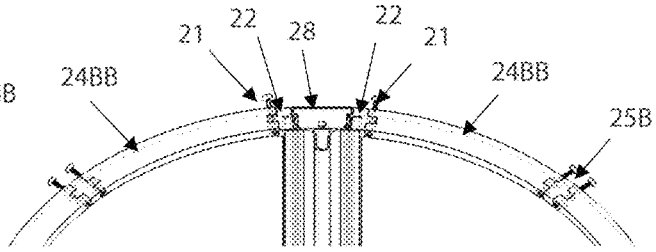
FIG. 43B presents a top isometric closeup view of a portion of a foldable shaft structure in a second embodiment disclosed herein.

FIG. 43A presents a top view of a foldable shaft structure in a second embodiment disclosed herein. Here are shown the top of four members 28 having two arms 24BB attached between each adjacent two members 28 such that only two arms 24BB attach to each member 28. A second end of an arm 24BB is attached using a dual hole therein with a corresponding hole in a support 22 that has been welded to a top portion of the member 28. A barrel and screw 21 fastener set attaches the arm 24BB to a pivot 25B using a dual hole in the first end of the arm 24BB and a corresponding hole in the pivot 25B; this is also similarly attached to a second arm 24BB using a separate hole in the pivot 25B and a corresponding dual hole in the second arm 24BB first end using another barrel and screw fastener 21 set. The second arm 24BB has its second end dual hole attached to a corresponding hole in another support 22 welded to another member 28. This attachment process is repeated about the top and bottom of the foldable shaft structure thereby forming a circular shape. FIG. 43B presents a top isometric closeup view of a portion of a foldable shaft structure in a second embodiment disclosed herein.

Figure 44A:
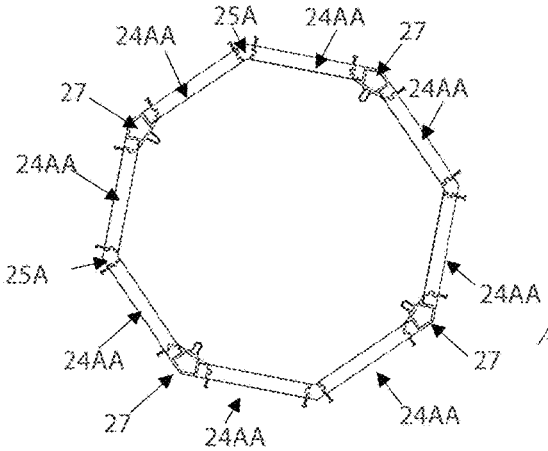
FIG. 44A presents a top view of a foldable shaft structure in a third embodiment disclosed herein.
Figure 44B:
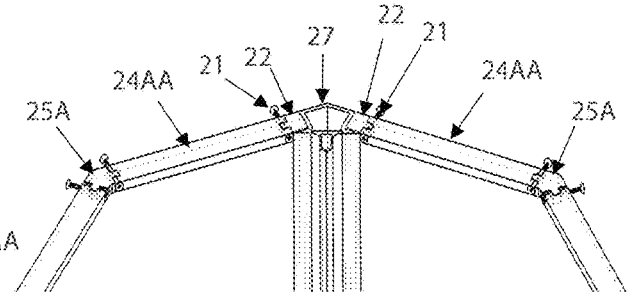
FIG. 44B presents a top isometric closeup view of a portion of a foldable shaft structure in a third embodiment disclosed herein.

FIG. 44A presents a top view of a foldable shaft structure in a third embodiment disclosed herein. Here are shown the top of four members 27 having two arms 24AA attached between each adjacent two members 27 such that only two arms attach to each member 27. A second end of an arm 24AA is attached (using barrel and screw 21 fastener) using a dual hole therein with a corresponding hole in a support 22 that has been welded to a top portion of the member 27. Barrel and screw 21 fasteners attach the arm 24AA to a pivot 25A using a dual hole in the first end of the arm 24AA and a corresponding hole in the pivot 25A; this is also similarly attached to another arm 24AA using a separate hole in the pivot 25A and a corresponding dual hole in the another arm 24AA using another barrel and screw fastener 21 set. The another arm 24AA has its second end dual hole attached (using barrel and screw 21 fastener) to a corresponding hole in another support 22 welded to another member 27. This attachment process is repeated about the top and bottom of the foldable shaft structure thereby forming an octagonal shape. FIG. 44B presents a top isometric closeup view of a portion of a foldable shaft structure in a third embodiment disclosed herein.

Figure 45:
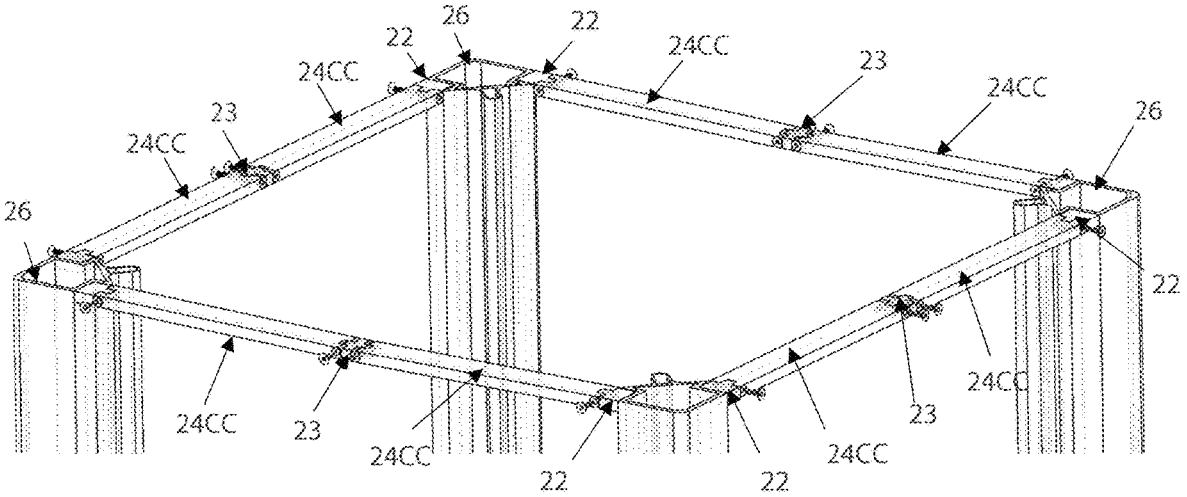
FIG. 45 presents a top isometric closeup view of a top portion of a foldable shaft structure in a first embodiment disclosed herein.

FIG. 45 presents a top isometric closeup view of a portion of a foldable shaft structure in a first embodiment disclosed herein. Here are shown the top of four members 26 having two arms 24CC attached between each adjacent two members 26 such that only two arms 24CC attach to each member 26 at top and two arms 24CC attach at bottom to each member 26. A second end of an arm 24CC is attached using (with barrel and screw 21 fastener) a dual hole therein with a corresponding hole in a support 22 that has been welded to a top portion of the member 26. Barrel and screw 21 fastener attaches the arm 24CC to a pivot 23 using a dual hole in the first end of the arm 24CC and a corresponding hole in the pivot 23; this is also similarly attached to another arm 24CC first end using a separate hole in the pivot 23 and a corresponding dual hole in the another arm 24CC first end using another barrel and screw fastener 21. The another arm 24CC has its second end dual hole attached to a corresponding hole in another support 22 welded to another member 26. This attachment process is repeated about the top and bottom of the foldable shaft structure thereby forming an circular shape.

Figure 46:
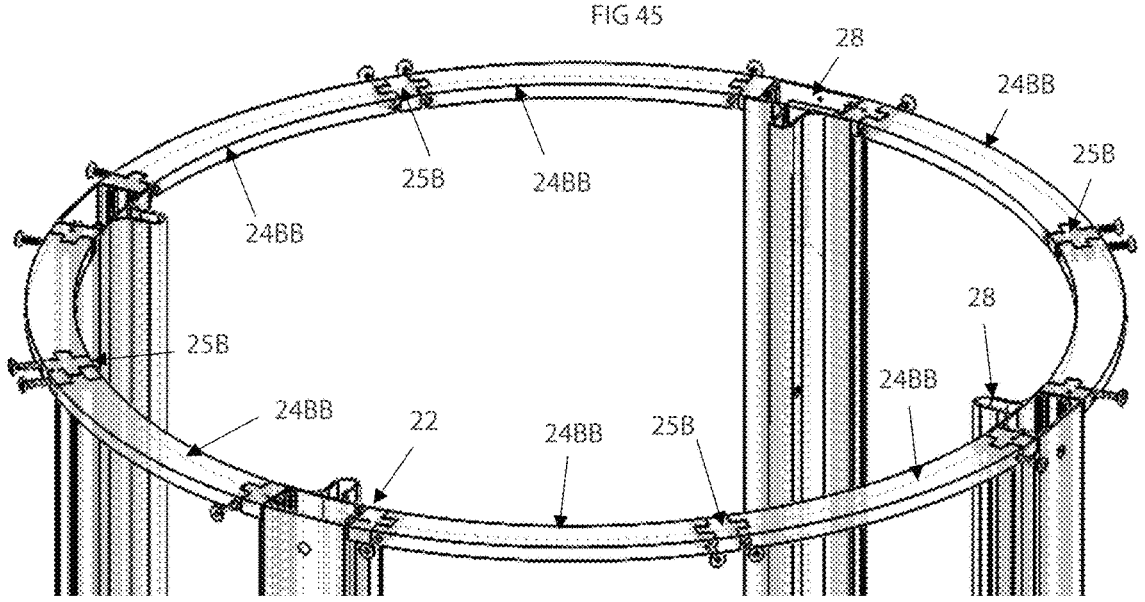
FIG. 46 presents a top isometric closeup view of a top portion of a foldable shaft structure in a second embodiment disclosed herein.

FIG. 46 presents a top isometric closeup view of a portion of a foldable shaft structure in a second embodiment disclosed herein. Here are shown the top of four members 28 having two arms 24BB attached between each adjacent two members 28 such that only two arms attach to each member 28 at top and two arms 24BB attach at bottom to each member 28. A second end of an arm 24BB is attached using a dual hole therein (using barrel and screw 21 fastener) with a corresponding hole in a support 22 that has been welded to a top portion of the member 28. Barrel and screw 21 fastener attaches the arm 24BB first end to a pivot 25B using a dual hole in the first end of the arm 24BB and a corresponding hole in the pivot 25B; this is also similarly attached to a another arm 24BB first end using a separate hole in the pivot 25B and a corresponding dual hole in the another arm 24BB first end using another barrel and screw fastener 21. The second arm 24BB has its second end dual hole attached (using barrel and screw 21 fastener) to a corresponding hole in another support 22 welded to another member 28. This attachment process is repeated about the top and bottom of the foldable shaft structure thereby forming a circular shape.

Figure 47:
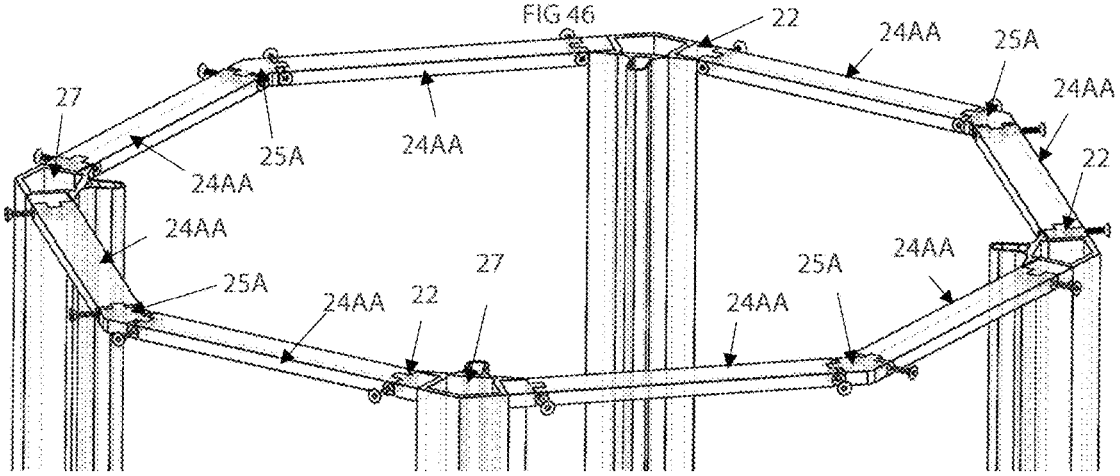
FIG. 47 presents a top isometric closeup view of a top portion of a foldable shaft structure in a third embodiment disclosed herein.

FIG. 47 presents a top isometric closeup view of a portion of a foldable shaft structure in a third embodiment disclosed herein. Here are shown the top of four members 27 having two arms 24AA attached between each adjacent two members 27 such that only two arms 24AA attach to each member 27 at top and two arms 24AA attach at bottom to each member 27. A second end of an arm 24AA is attached using a dual hole therein (using barrel and screw 21 fastener) with a corresponding hole in a support 22 that has been welded to a top portion of the member 27. Barrel and screw 21 fastener attaches the arm 24AA to a pivot 25A using a dual hole in the first end of the arm 24AA and a corresponding hole in the pivot 25A; this is also similarly attached to another arm 24AA using a separate hole in the pivot 25A and a corresponding dual hole in the another arm 24AA first end using another barrel and screw fastener 21. The second arm 24AA has its second end dual hole attached (using barrel and screw 21 fastener) to a corresponding hole in another support 22 welded to another member 27. This attachment process is repeated about the top and bottom of the foldable shaft structure thereby forming an octagonal shape.

Figure 48A:
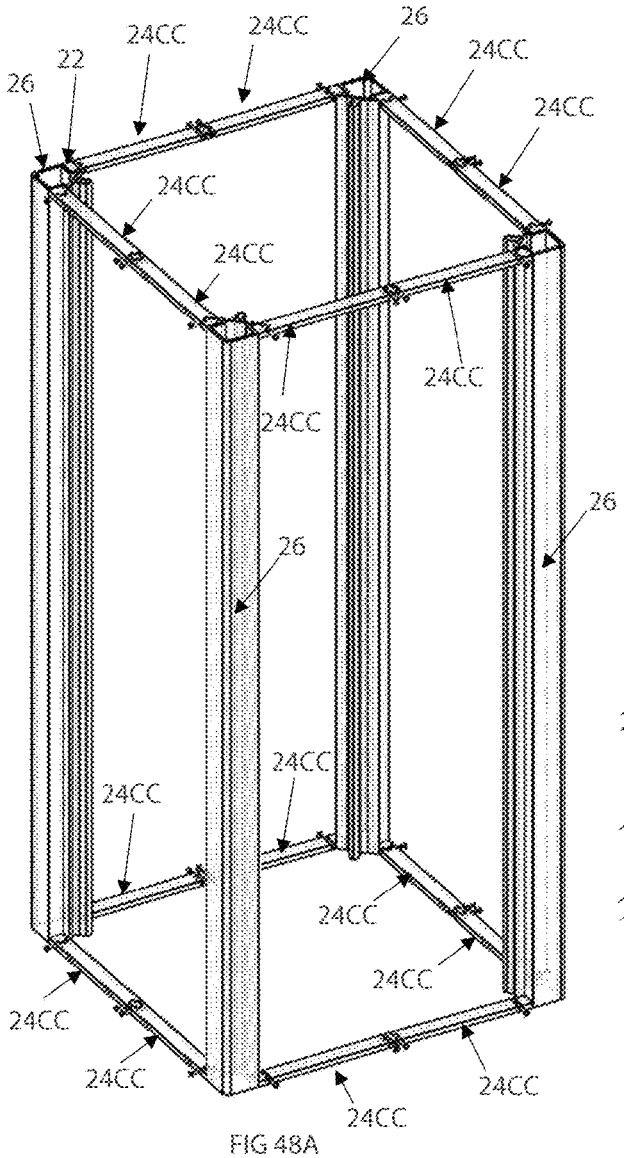
FIG. 48A presents an isometric view of the foldable shaft structure in a first embodiment disclosed herein.

FIG. 48A presents an isometric view of the foldable shaft structure in a first embodiment disclosed herein. Here are shown four members 26 arranged vertically and attached at a top portion of two adjacent members 26 and at a bottom portion of two adjacent members 26 as previously described thereby forming a square structure as the attachment is repeated between each successive pair of members. The first end of each of two arms 24AA are attached to a pivot using two sets of barrel and screw fasteners; a first arm 24AA is attached at its second end to a top portion of a first member 26 and a second arm 24AA is attached at its second end to a second member 26 top portion. The other top portions of the other adjacent members are similarly attached forming a square shape The bottom portions of the various members 26 are similarly attached.

Figure 48B:
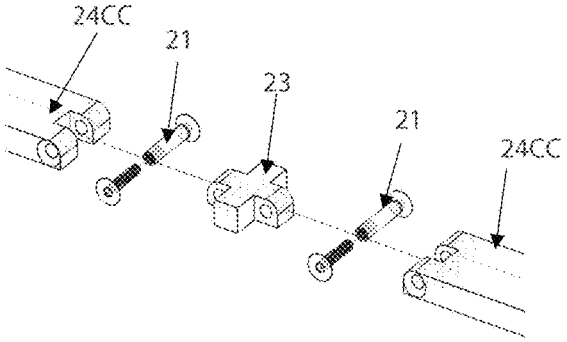
FIG. 48B presents a closeup view of a joint between two arms of the foldable shaft structure in a first embodiment disclosed herein.

FIG. 48B presents a closeup view of a joint 23 between two arms 24CC of the foldable shaft structure in a first embodiment disclosed herein. Here a first end of a first arm 24CC has a dual hole therein for attachment to a first hole in a pivot 23 using a first barrel and screw fastener 21 set. Then a first end of a second arm 24CC has a dual hole therein for attachment to a second hole in a pivot 23 using a second barrel and screw fastener 21 set.

Figure 48C:
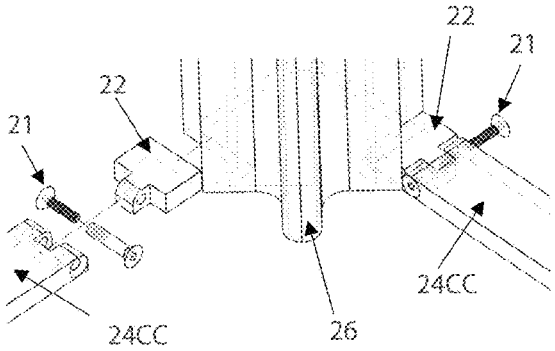
FIG. 48C presents a closeup view of a connection between an end of an arm and a bottom portion of a member of the foldable shaft structure in a first embodiment disclosed herein.

FIG. 48C presents an closeup view of a connection between an end of an arm 24CC and a bottom portion of a member of the foldable shaft structure in a first embodiment disclosed herein. A bottom portion of a member 26 is shown having a space for welded attachment of a first support 22 at bottom left in the figure; also, member 26 has a space for welded attachment of second support 22 at bottom right which is at an angle with the first support 22. A first arm 24CC is shown at left having its second end having a dual hole therein attached to a first support 22 using a hole in first support 22 for concentric attachment with screw and barrel 21 fastener set. Also shown is a second arm 24CC having its second end having a dual hole therein attached to a second support 22 using a hole in second support 22 for concentric attachment with screw and barrel 21 fastener set.

Figure 49A:
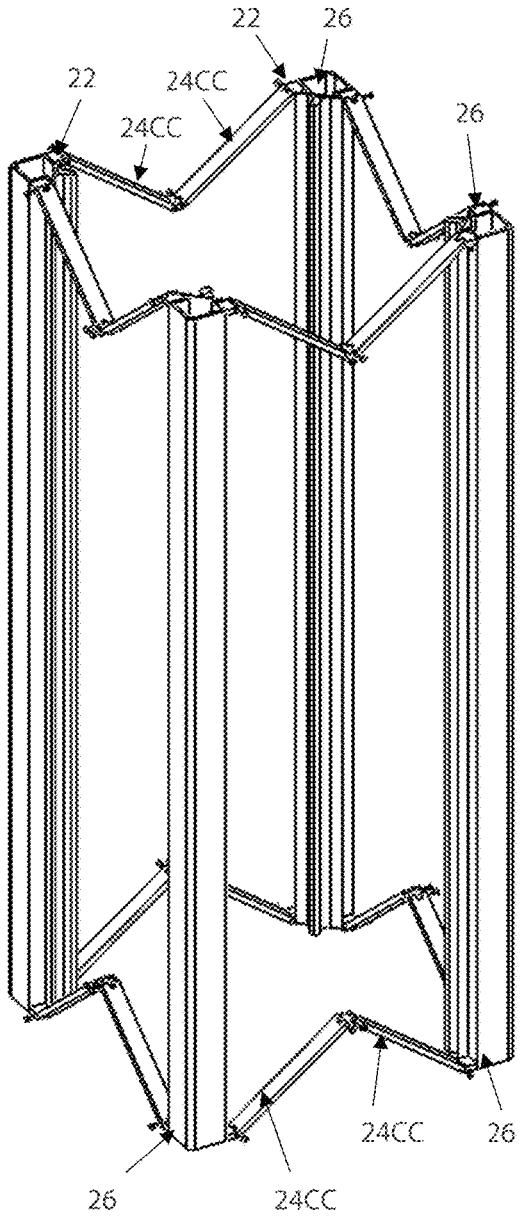
FIG. 49A presents an isometric view of a partially closed or open foldable shaft structure in a first embodiment disclosed herein.

FIG. 49A presents an isometric view of a partially closed or open foldable shaft structure in an embodiment disclosed herein. Here the four sets of two arms 24CC are attached at the top portions of two adjacent members 26 and the four sets of two other arms 24CC are attached at the bottom portions of two adjacent members 26 and this is repeated about the four vertical members 26. The two arms 24CC are folded about the pivot 23 between them and the four sets of top member 24 are folded downwards whilst the four sets of bottom members 24 are folded upwards.

Figure 49B:
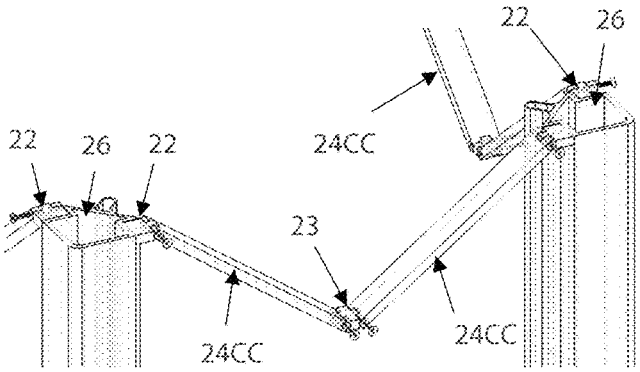
FIG. 49B presents an isometric closeup top portion view of a partially closed or partially open foldable shaft structure in a first embodiment disclosed herein.

FIG. 49B presents an isometric closeup top portion view of a partially closed or partially open foldable shaft structure in an embodiment disclosed herein. Proceeding from the top portion of the leftmost member 26 one finds a support 22 welded thereto and a second end of a first arm 24CC attached thereto using holes in support 22 and dual hole in arm 24CC second end for attachment together using a barrel and screw fastener 21. The central pivot 23 between the two arms 24CC is attached with two oppositely situated holes in the pivot 23 for a first end of the first arm 24 and for the first end of the second arm 24CC at right using barrel and screw fasteners 21. Finally, the second arm 24CC has its second end attached to a support 22 using a hole in support 22 and dual hole in arm 24CC second end for attachment using a barrel and screw fastener 21. The second support 22 is of course welded to the top portion of the rightmost member 26.

Figure 49C:
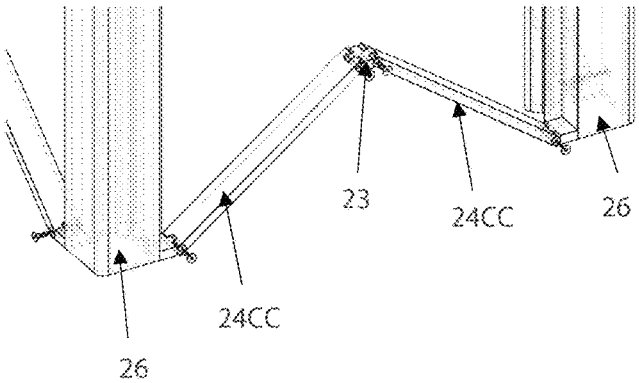
FIG. 49C presents an isometric closeup bottom portion view of a partially closed or partially open foldable shaft structure in a first embodiment disclosed herein.

FIG. 49C presents an isometric closeup bottom portion view of a partially closed or partially open foldable shaft structure in an embodiment disclosed herein. Proceeding from the bottom portion of the leftmost member 26 one finds a support 22 welded thereto and a second end of a first arm 24CC attached thereto using holes in support 22 and dual hole in arm 24CC second end for attachment together using a barrel and screw fastener 21 set. The central pivot 23 between the two arms 24CC is attached with two holes in the pivot 23 one for a first end dual hole of the first arm 24CC and one for the first end dual hole of the second arm 24CC at right using barrel and screw fasteners 21. Finally, the second arm 24CC has its second end attached to a support 22 using a hole in support 22 and dual hole in arm 24CC second end for attachment using a barrel and screw fastener 21. The second support is of course welded to the bottom portion of the rightmost member 26.

Figure 50A:
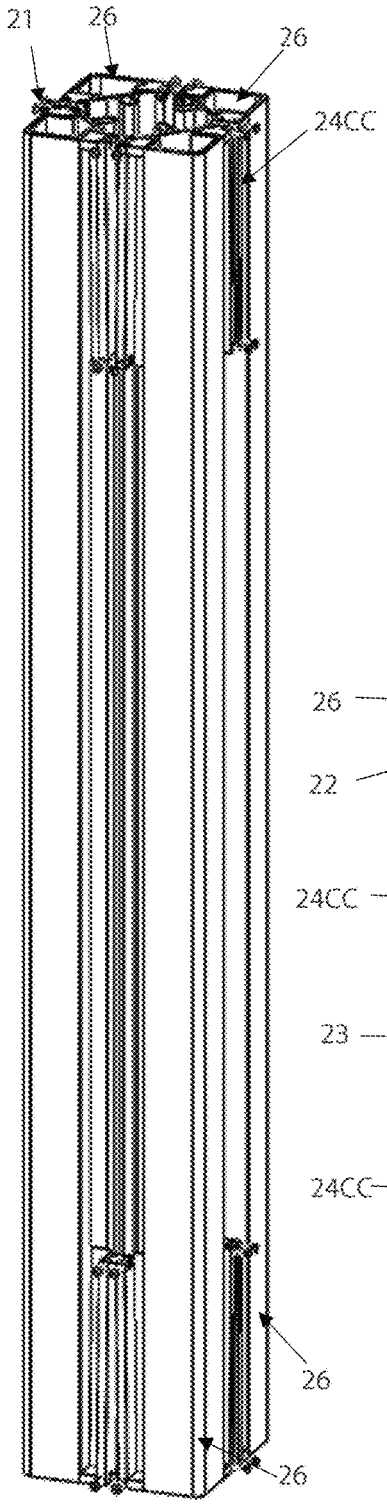
FIG. 50A presents a CLOSED position of the foldable shaft structure in a first embodiment disclosed herein.

FIG. 50A presents a front isometric CLOSED position view of the foldable shaft structure in a first embodiment disclosed herein. Four members 26 are shown at the vertical periphery thereof along with folded members 24CC attached to top and bottom portions in front and on the right side of the drawings between adjacent two members.

Figure 50B:
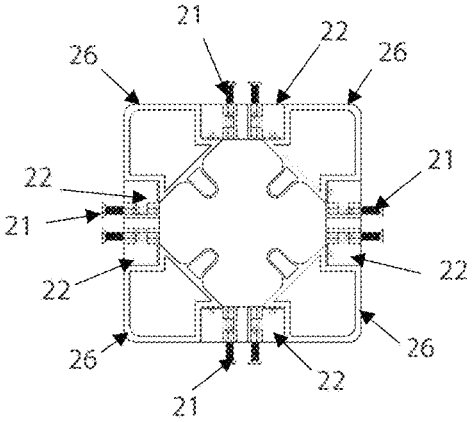
FIG. 50B presents a top CLOSED view of the top portion of the foldable shaft structure in a first embodiment disclosed herein.

FIG. 50B presents a top CLOSED view of the top portion of the foldable shaft structure in a first embodiment disclosed herein. Here four members 26 are shown from the top of the foldable shaft structure. Between two adjacent members 26 are a first support 22 welded to a top portion of a first member 26 and a second support 22 welded to a top portion of a second member 26. Between these two supports are two narrowly defined arms 24CC the first of which is attached to the first support 22 using corresponding holes in the first support 22 and the first arm 24CC; likewise, the second arm 24CC is attached to the second support 22 using corresponding holes in the second support 22 and the second arm 24CC. Finally, there is (not shown in this view) a connection by the first end of the first arm 24CC to a pivot (not shown) through corresponding holes between these two and a connection by the first end of the second arm 24CC to the pivot (not shown) through corresponding holes between these two. Various fastener barrel and screw sets 21 facilitate the connections.

Figure 50C:
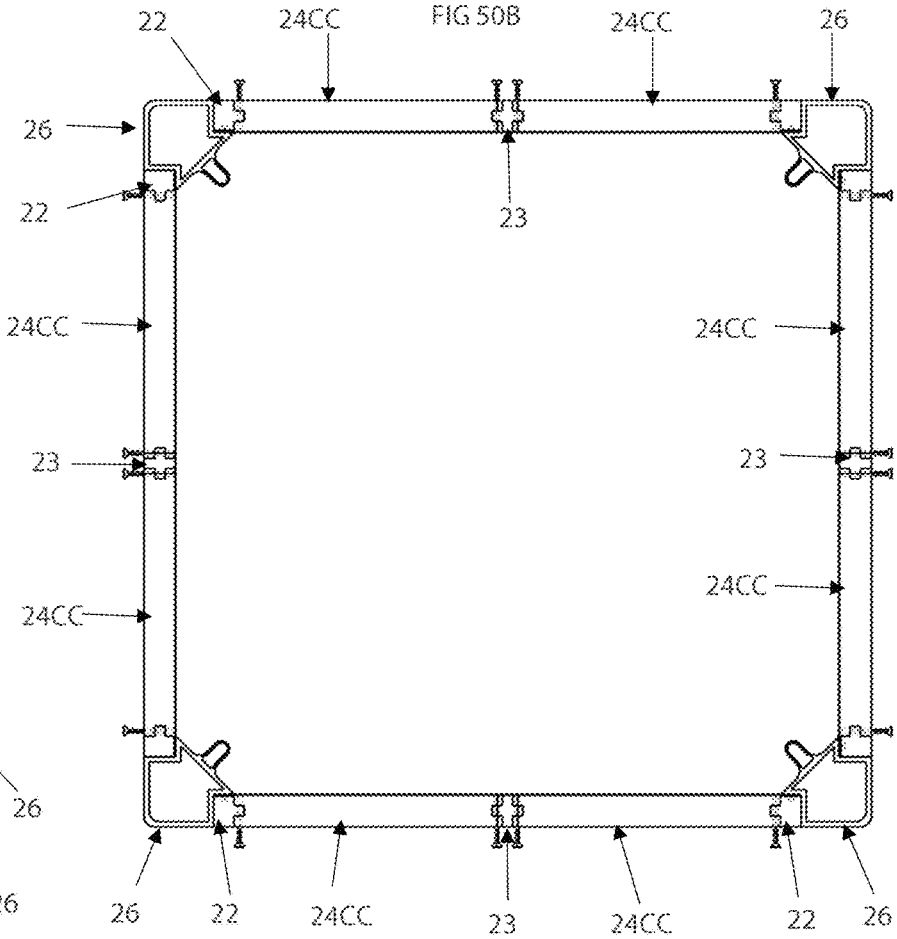
FIG. 50C presents a top OPEN view of the top portion of the foldable shaft structure in a first embodiment disclosed herein.

FIG. 50C presents a top OPEN view of the top portion of the foldable shaft structure in a first embodiment disclosed herein. Here four members 26 and various other components are shown from the top of the foldable shaft structure. Between two adjacent members 26 are a first support 22 welded to a top portion of a first member 26 and a second support 22 welded to a top portion of a second member 26. Between these two supports 22 are two arms 24CC the first of which is attached to the first support 22 using corresponding holes in the first support 22 and the first arm; likewise, the second arm 24CC is attached to the second support 22 using corresponding holes in the second support 22 and the second arm 24CC. Finally, there is a connection by the first end of the first arm 24CC to a pivot 23 through corresponding holes between these two; there is also a connection by the first end of the second arm 24CC to the pivot 23 through corresponding holes between these two. These connections use four sets of barrel and screw 21 fasteners between a single assembly at top or bottom between two adjacent members 26. This connection is repeated around the circuit of the overall structure between other sets of members 26 at top and bottom of members 26.

Figure 51A:
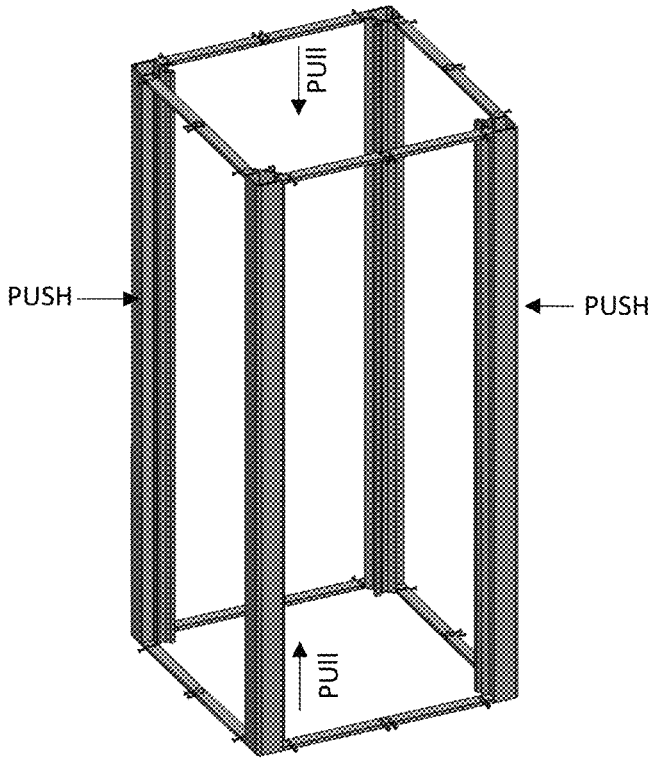
FIG. 51A presents an isometric view of an OPEN POSITION of a foldable shaft structure in a first embodiment herein disclosed.

FIG. 51A presents an isometric view of an OPEN POSITION of a foldable shaft structure in a first embodiment herein disclosed. Once created at a manufacturer's facility, a finished foldable shaft structure is tested and placed into an OPEN POSITION. To prepare the frame for transport a user pulls down on one or more of the top assemblies and pulls up on one or more of the bottom assemblies and pushes the members inwards from one or more sides thereby causing motion towards the center of the frame. Here an assembly is the two supports each attached to a single one of two adjacent members wherein a support is attached to one arm and the other support is attached to another arm and wherein the two arms attach together through the pivot. An assembly is an arm connected to another arm through a pivot wherein this assembly is connected to two members one for each arm; wherein the connection is at an end of the first arm to a first member and at an end of the second arm to the second member. More specifically, through a first and second support as described elsewhere herein; also, such that the first support is movably connected to the first arm but rigidly connected to the first member whilst the second support is movably connected to the second arm but rigidly connected to the second member.

Figure 51B:
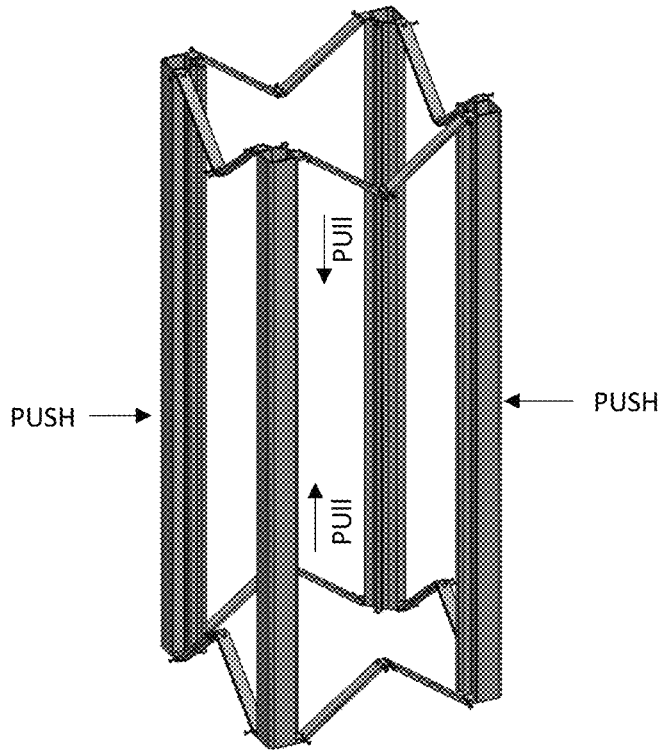
FIG. 51B presents an isometric view of a HALF OPEN POSITION of a foldable shaft structure in a first embodiment herein disclosed.
Figure 51C:
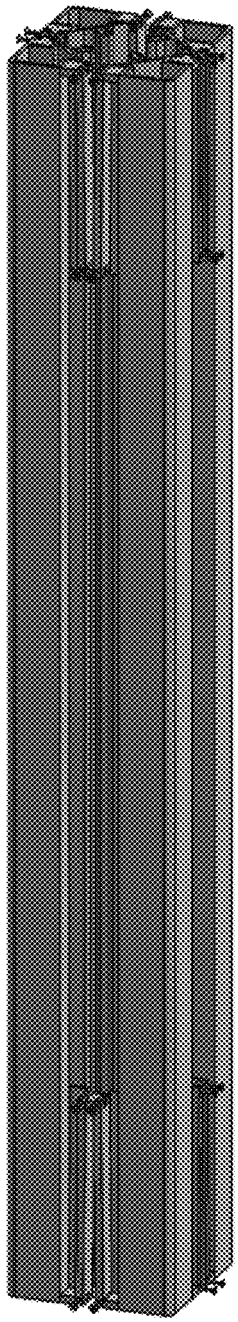
FIG. 51C presents an isometric view of a CLOSED POSITION of a foldable shaft structure in a first embodiment herein disclosed.

FIG. 51B presents an isometric view of a HALF OPEN POSITION (or partially open position) of a foldable shaft structure in a first embodiment herein disclosed. After the user has moved the frame as indicated in FIG. 51A the frame is in this HALF-OPEN POSITION (or partially open position). The user then continues the same procedure, in other words, a user pulls down on one or more of the top assemblies and pulls up on one or more of the bottom assemblies and pushes inwards on the members from one or more sides thereby causing motion towards the center of the foldable shaft structure. FIG. 51C presents an isometric view of a CLOSED POSITION of a foldable haft structure in a first embodiment herein disclosed; this once the limits of the motion have been reached whereby the entire foldable shaft structure has had its top and bottom assemblies completely folded. It should be apparent from the disclosure that the other embodiments are opened and closed using the sam procedure.

Figure 52:
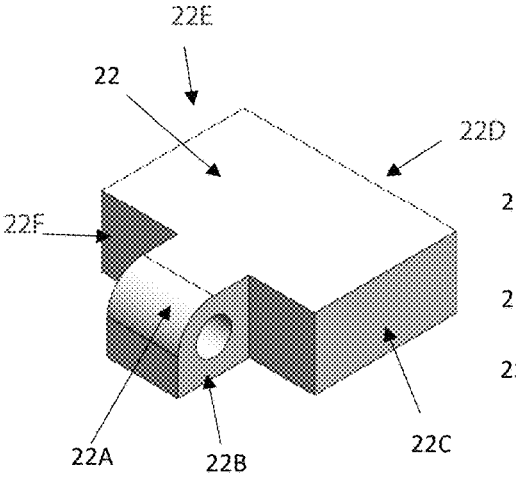
FIG. 52 presents an isometric view of a support 22 in an embodiment disclosed herein.

FIG. 52 presents an isometric view of a support 22 used in various embodiments disclosed herein. The support 22 is a single piece of material having a generalized square or rectangular shape. It has a back surface 22D which is to be welded to various portions of members 26, 27, 28 as appropriate in the particular implementation. The front surface has a protrusion 22A at its center that extends out from the main body of support 22. The protrusion 22A has a straight top portion then a curved intermediate portion then a straight vertical portion; within the protrusion 22A there is a hole 22B that cuts from one side of the protrusion to the other. The right 22C and left 22E portions of the support 22 are both flat surfaces.

Figure 53A:
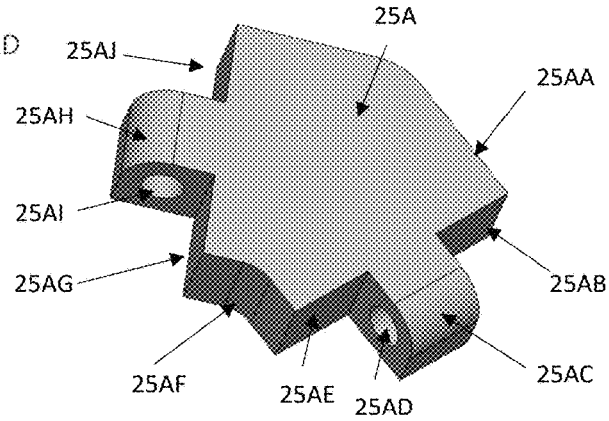
FIG. 53A presents an isometric view of a pivot 25A of the foldable shaft structure in a third embodiment disclosed herein.

FIG. 53A presents an isometric view of a pivot 25A of the foldable shaft structure in a third embodiment disclosed herein. This pivot 25A has a unique structure that is utilized to form the octagonal structure described herein. It has a generally flat bottom and top surfaces as well as a left protrusion 25AH and a right protrusion 25AC situated at an angle there between at opposing ends of the pivot 25A. First, the rear surface 25AA has a triangular (or arrow head) shape with a top of the triangle (or arrow head) disposed outwards and integrating along an edge with 25AJ. Proceeding clockwise about the part 25AA integrates with 25AB along a common edge. This small flat surface 25AB then integrates with an edge of a first protrusion 25AC; this first protrusion 25AC has a hole 25AD passing there through for attachment of an arm 24AA. Another edge of the first protrusion 25AC integrates with another small flat surface 25AE that in turn integrates with an edge of a small inwardly directed three faceted shape 25AF; these three facets are to follow the general direction (inward arrow head) of the rear surface 25AA. Another edge of the faceted shape 25AF integrates with a small flat surface 25AG that itself integrates with an edge of a second protrusion 25AH; this second protrusion 25AH has a hole 25AI passing there through for attachment of an arm 24AA. Finally, another edge of the second protrusion 25AH integrates with another small flat surface 25AJ that returns to integrate with an edge of rear surface 25AA thereby completing the structure.

Figure 53B:
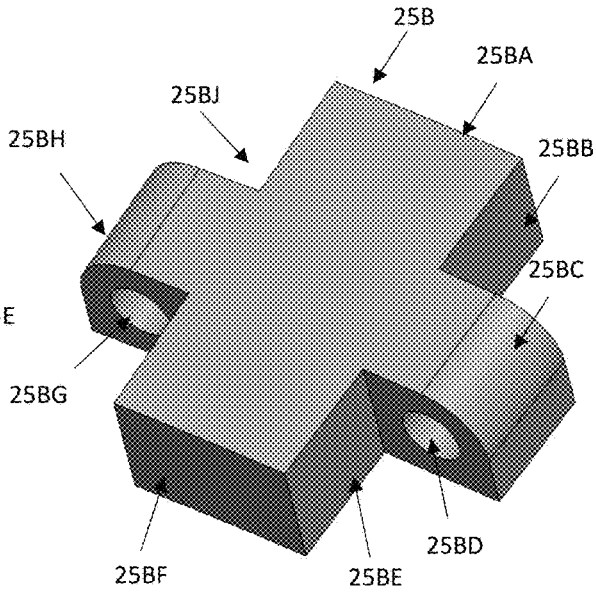
FIG. 53B presents an isometric view of a pivot 25B of the foldable shaft structure in a second embodiment disclosed herein.

FIG. 53B presents an isometric view of a pivot 25B of the foldable shaft structure in a second embodiment disclosed herein. Pivot 25B is generally in a cross or plus shape with two square or rectangular protrusions 25BA, 25BF disposed opposite one another. There are also two other protrusions 25BH on the left and 25BC disposed on the right in the drawings. Within each of these is a hole 25BG in 25BH and 25BD in 25BC for attachment using barrel and screw fasteners 21 to arms 24BB in the second embodiment. Surface 25BD integrates along a common edge with the back surface 25BA and with an edge of protrusion 25BH. Right surface 25BB integrates along an edge of 25BA and also integrates with an edge of protrusion 25BC. Right bottom surface 25BE integrates along an edge of protrusion 25BC and with 25BF along another edge. A left bottom surface integrates with an edge of 25BF and another edge of protrusion 25BH.

Figure 54:
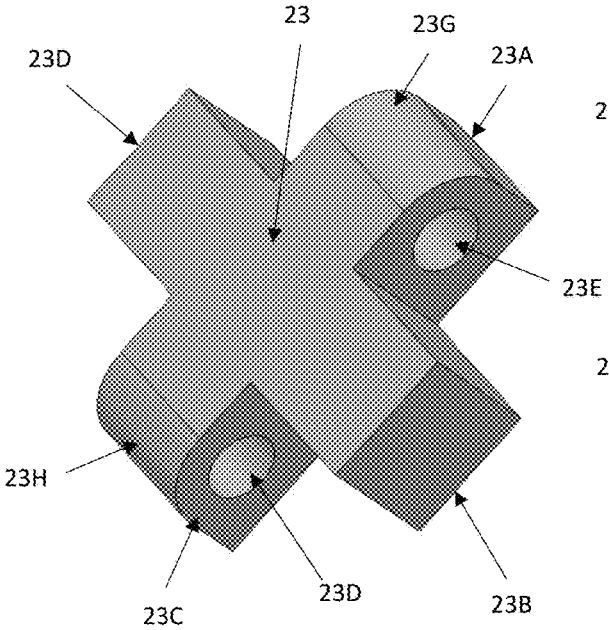
FIG. 54 presents an isometric view of a pivot 23 of the foldable shaft structure in a first embodiment disclosed herein.

FIG. 54 presents an isometric view of a pivot 23 of the foldable shaft structure in a first embodiment disclosed herein. The pivot 23 has a plus or cross shape having four wings; two of the wings 23B, 23D are square or rectangular and are disposed opposite one another. The other two wings 23A, 23C are disposed opposite one another and situated so as to form a plus, cross shape or similar shape (+t) along with 23B, 23D. There are two holes one 23E passing through the wing 23A and the other 23D passing through the wing 23C. Finally, the top portion of the wings 23A, 23C have one of rounded edges 23G, 23H; this happens as these start from the top flat surface of 23 moving outwards horizontally flat then curving and then proceeding down straight again.

Figure 55:
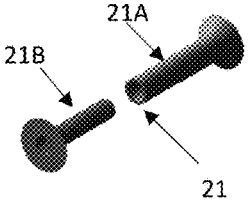
FIG. 55 presents an isometric view of a barrel and screw 21 fastener of the foldable shaft structure in an embodiment disclosed herein.

FIG. 55 presents an isometric view of a barrel and screw 21 fastener of the foldable shaft structure in various embodiments disclosed herein. A barrel 21A has a small threaded cavity therein for attachment of a threaded screw 21B therein.

Figure 56A:
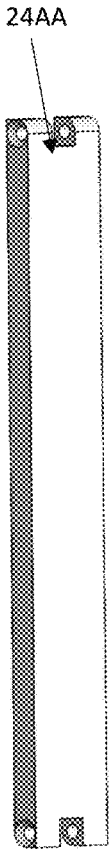
FIG. 56A presents an isometric view of the arm 24AA in a third embodiment disclosed herein.

FIG. 56A presents an isometric view of the arm 24AA in a third embodiment disclosed herein. The arm 24AA is a longitudinal device having a top end and a bottom end. The top end and the bottom ends each have two protrusions cooperating together to form an attachment point for a support or an attachment point for a pivot. The top two protrusions have a curved portion facing forward in the drawing and the bottom two protrusions in the drawing also have a curved portion facing backwards in the drawing.

Figure 56B:
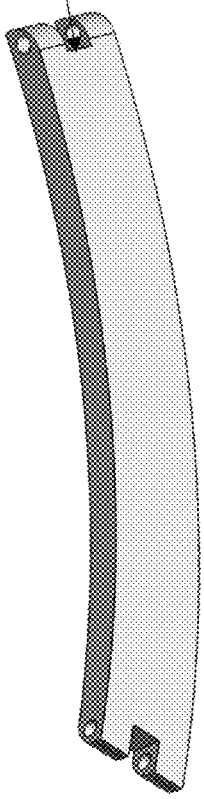
FIG. 56B presents an isometric view of the arm 24BB in a second embodiment disclosed herein.

FIG. 56B presents an isometric view of the arm 24BB in a second embodiment disclosed herein. Here the arm 24BB is arranged in a curved fashion.

Figure 56C:
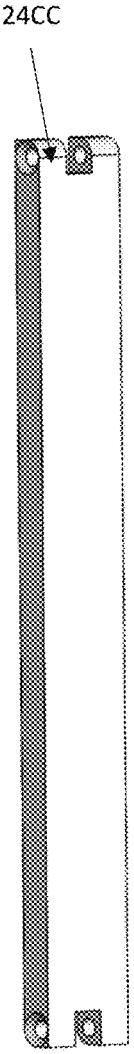
FIG. 56C presents an isometric view of the arm 24CC in a first embodiment disclosed herein.

FIG. 56C presents an isometric view of the arm 24CC in a first embodiment disclosed herein.

Figure 56D:
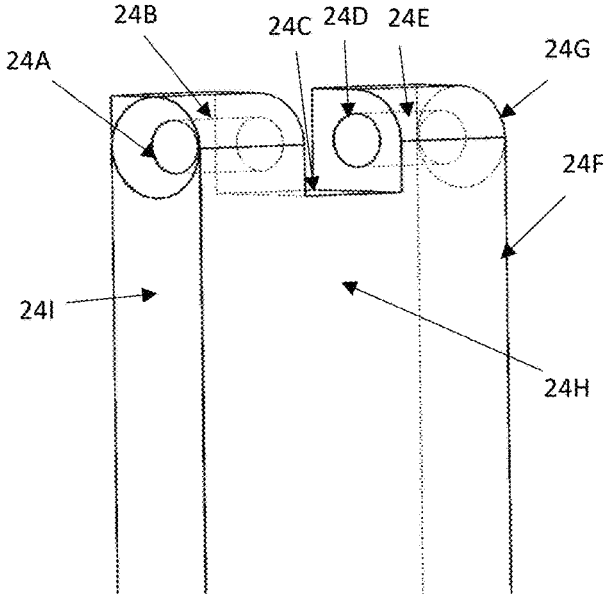
FIG. 56D presents a top portion of either of FIG. 56A, FIG. 56C in a third and first embodiment disclosed herein.

FIG. 56D presents a closeup top isometric view of the arms 24AA, 24CC in a third and first embodiments disclosed herein. The arms 24AA, 24CC has a front 24H and back longitudinal surfaces as well as a right longitudinal surface 24F into the page and a left longitudinal surface 24I out of the page. The left protrusion 24B has a hole 24A and the right protrusion 24G has another hole 24D therein. The left protrusion 24B has a flat portion that becomes a curved edge and then flattens as it integrates downwards into the front longitudinal surface 24H of arms 24AA, 24CC. Similarly, the right protrusion 24G has a flat portion that becomes a curved edge 24E and then flattens as it integrates downwards into the front longitudinal surface 24H of arms 24AA, 24CC. Between the two protrusions 24B, 24G there is a cutout 24C sufficiently deep to permit the insertion of a barrel and fastener 21 through holes 24A, 24D for individual attachment of the arms 24AA, 24CC in various ways with pivots (25A, 23) and supports 22 as described herein. Here pivot (25A, 23) has one of its protrusions with a hole placed in a cutout of a first arm; and a second arm has its cutout filled by the other protrusion (with a hole therein) of the pivot.

Figure 56E:
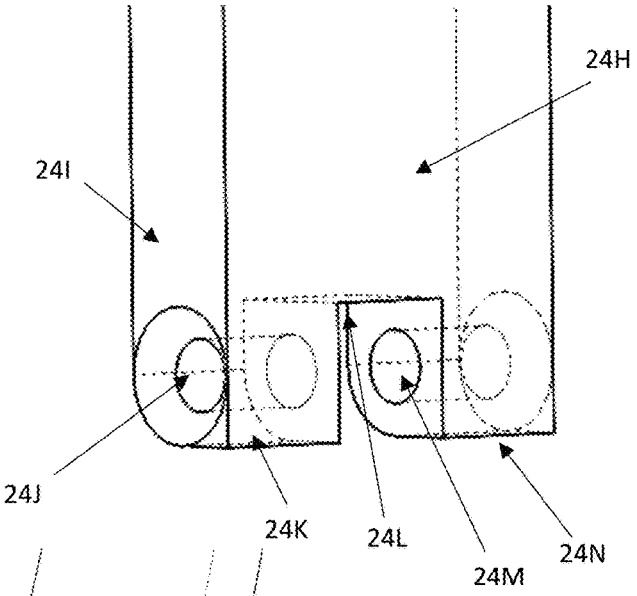
FIG. 56E presents a bottom portion of either of FIG. 56A, FIG. 56C in a third and first embodiment disclosed herein.

FIG. 56E presents a closeup bottom isometric view of the arms 24AA, 24CC in a third and first embodiments disclosed herein. The arms 24AA, 24CC have a front and back longitudinal surfaces as well as a right longitudinal surface 24F into the page and a left longitudinal surface 24I out of the page. The left downwards protrusion 24K has a hole 24J and the right downwards protrusion 24N has another hole 24M therein. The left downwards protrusion 24K has a flat portion that becomes a curved edge and then flattens as it integrates upwards into the back longitudinal surface of arms 24AA, 24CC. Similarly, the right downwards protrusion 24N has a flat portion that becomes a curved edge and then flattens as it integrates upwards into the back longitudinal surface of arms 24AA 24CC. Between the two protrusions 24K, 24N there is a cutout 24L sufficiently deep to permit the insertion of a fasteners through holes 24J, 24M for attachment of the arms 24AA, 24CC in various ways with pivots (25A, 23) and supports 22 as described herein. Here pivot (25A, 23) has one of its protrusions with a hole placed in a cutout of a first arm; and a second arm has its cutout filled by the other protrusion (with a hole therein) of the pivot. It should be apparent from the drawings that curved portions on the top and bottom portions are disposed in opposing fashion to one another. Thus, on the top front of the part there is a curve towards the user whist the curve on the bottom back of the part is away from the user.

Figure 56F:
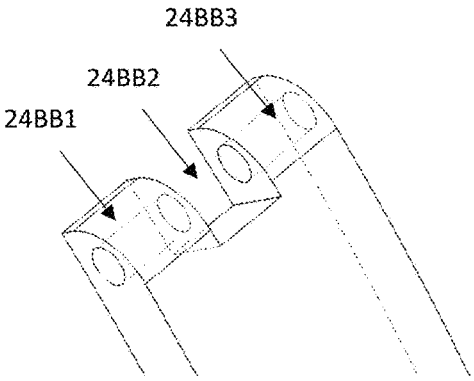
FIG. 56F presents a top portion of FIG. 56B in a second embodiment disclosed herein.

FIG. 56F presents a top portion of the arm 24BB shown in FIG. 56B in a second embodiment disclosed herein. The top portion shown in the figure has two upward protrusions 24BB1 and 24BB3 having a cutout 24BB2 in the arm 24BB. The protrusions are disposed with a curved portion on a side thereof for appropriate turning of the item; this feature was previously described with respect to the members shown in FIG. 56A, FIG. 56C-E. Here pivot (25B) has one of its protrusions with a hole placed in a cutout of a first arm; and a second arm has its cutout filled by the other protrusion (with a hole therein) of the pivot. It should be apparent from the drawings that curved portions on the top and bottom portions are disposed in opposing fashion to one another.

Figure 56G:
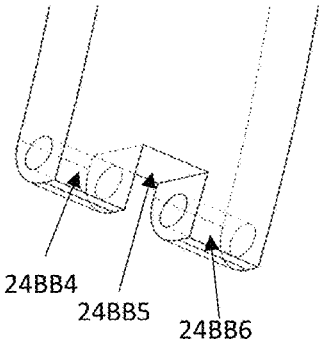
FIG. 56G presents a bottom portion of FIG. 56B in a second embodiment disclosed herein.

FIG. 56G presents a bottom portion of the arm 24BB shown in FIG. 56B in a second embodiment disclosed herein. The bottom portion shown in the figure has two downward protrusions 24BB4 and 24BB6 having a cutout 24BB5 in the member 24BB. The protrusions are disposed with a curved portion on a side thereof for appropriate turning of the item; this feature was previously described with respect to the members shown in FIG. 56A, FIG. 56C-E. It should be apparent from the drawings that curved portions on the top portion and disposed in opposing fashion to the one on the opposite side thereof. Thus, on the top front of the part there is a curve towards the user whist the curve on the back bottom of the part is away from the user. Here pivot (25B) has one of its protrusions with a hole placed in a cutout of a first arm; and a second arm has its cutout filled by the other protrusion (with a hole therein) of the pivot. It should be apparent from the drawings that curved portions on the top and bottom portions are disposed in opposing fashion to one another.

Figure 57A:
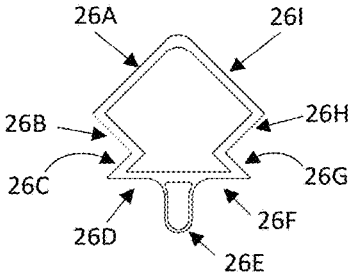
FIG. 57A presents a top view of a member 26 in a first embodiment disclosed herein.

FIG. 57A presents a top view of a member 26 in a first embodiment disclosed herein.

Figure 57B:
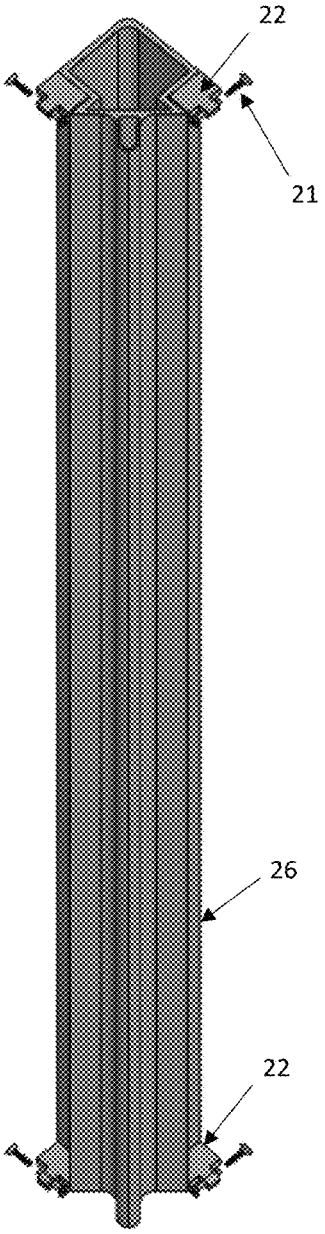
FIG. 57B presents an isometric view of a member 26 in a first embodiment disclosed herein.

FIG. 57B presents a front isometric view of a member 26 in a first embodiment disclosed herein. The member 26 has a top portion at left for welded attachment to a first support 22 and at top portion right for welded attachment to a second support 22. The member 26 has a bottom portion at left for welded attachment to a third support 22 and a bottom portion at right for welded attachment to a fourth support 22. Supports 22 are used to attached various arms using barrel and screw fasteners 21.

Figure 57C:
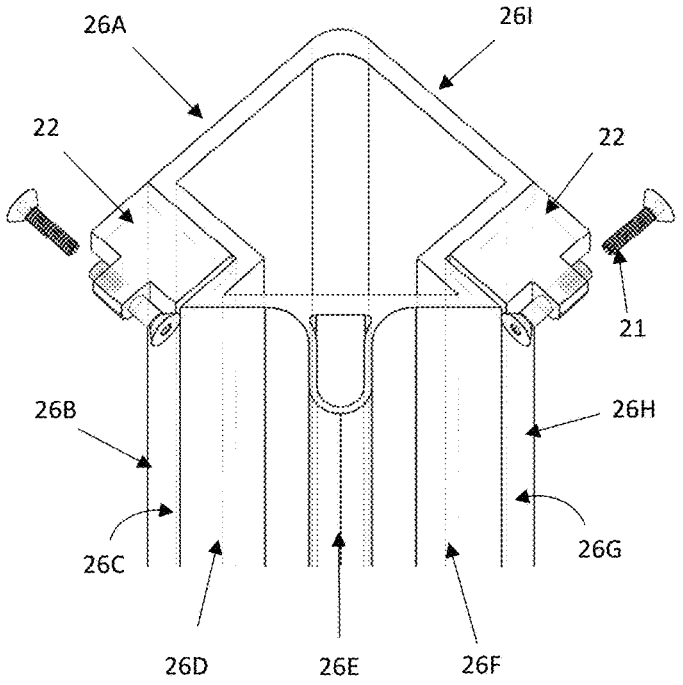
FIG. 57C presents a closeup top isometric view of a member 26 in a first embodiment disclosed herein.

FIG. 57C presents a closeup front top isometric view of a member 26 in a first embodiment disclosed herein. The member 26 has various contours running down its entire length unless otherwise specified. The member 26 has a hollow central region enclosed as follows. A left back portion 26A integrates along a curved edge with a right back portion 26I. A first left angled portion 26B integrates along a first common edge with the left back portion 26A and moves to the right but downwards; the first left angled portion 26B also integrates along its second edge common with a second left angled portion 26C that moves down and to the left in the drawing. The second left angled portion 26C has another edge in common with a left front surface 26D; this left front surface 26D moves to the right and curves into a forward protrusion 26E. This forward protrusion 26E has a right front surface 26F that curves into it from the right. The right front surface 26F integrates along a common edge with a second right angled portion 26G that angles upwards and to the left. The second right angled portion 26G has a common edge with a first right angled portion 26H that moves to the right and upwards; the first right angled portion 26H has a common edge with the right back portion 26I completing the structure. The backs 26A, 26B, 26C, 26D, 26F, 26G, 26H, 26I and a small internal support (behind 26E) between the left front surface 26D and the right front surface 26F enclose the hollow central region. The first left angled portion 26B and the first right angled portion 26H are utilized to attach two supports 22 one to each portion 26B, 26H near or at their respective tops. Barrel and screw 21 Fasteners use this for attachment to arms therewith.

Figure 57D:
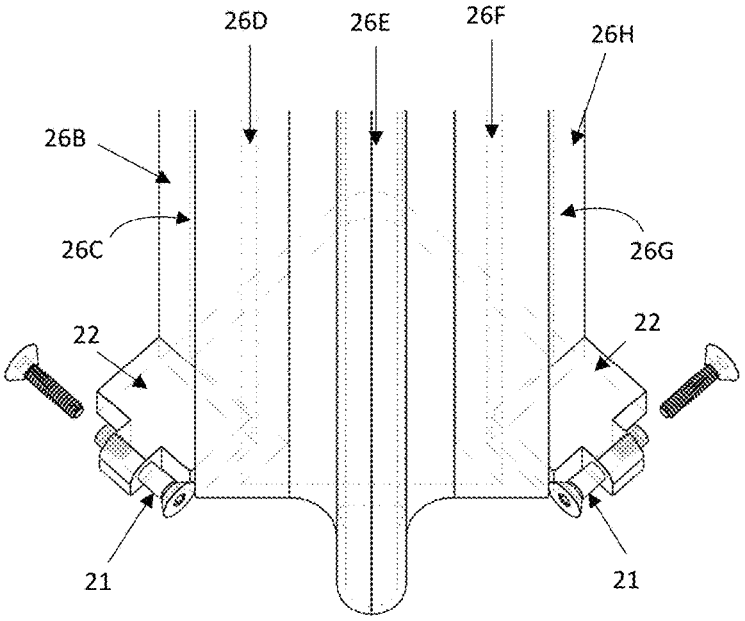
FIG. 57D presents a closeup bottom isometric view of a member 26 in a first embodiment disclosed herein.

FIG. 57D presents a closeup front bottom isometric view of a member 26 in a first embodiment disclosed herein. Again the first left angled portion 26B and the first right angled portion 26H are utilized to attach two supports 22 one to each portion 26B, 26H near or at their respective bottoms. Barrel and screw 21 Fasteners 21 use this for attachment to arms therewith.

Figure 58A:
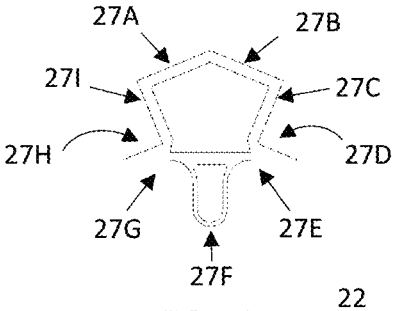
FIG. 58A presents a top view of a member 27 in a third embodiment disclosed herein.

FIG. 58A presents a top view of a member 27 in a third embodiment disclosed herein.

Figure 58B:
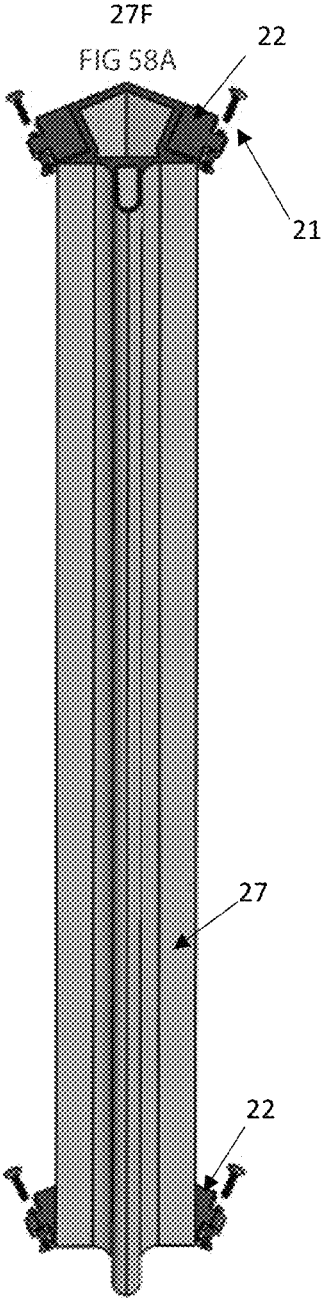
FIG. 58B presents an isometric view of a member 27 in a third embodiment disclosed herein.

FIG. 58B presents a front isometric view of a member 27 in a third embodiment disclosed herein. The member 27 has a top portion at left for welded attachment to a first support 22 and a top portion at right for welded attachment to a second support 22. The member 27 has a bottom portion at left for welded attachment to a third support 22 and a bottom portion at right for welded attachment to a fourth support 22. Supports 22 are used to attached various arms using barrel and screw fasteners 21.

Figure 58C:
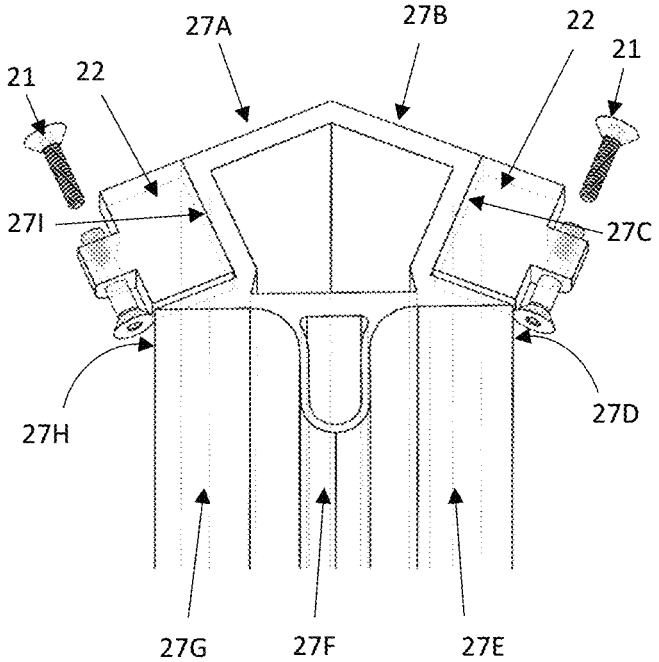
FIG. 58C presents a closeup top isometric view of a member 27 in a third embodiment disclosed herein.

FIG. 58C presents a closeup front top isometric view of a member 27 in a third embodiment disclosed herein. The member 27 has various contours running down its entire length unless otherwise specified. The member 27 has a hollow central region enclosed as follows; a left back portion 27A moves to the right and upwards and integrates along a common edge with a right back portion 27B. The right back portion 27B moves to the right down slightly and integrates with a first right angled portion 27C; this moves to the left but downwards and integrates along a common edge with a second right angled portion 27D that moves down and to the right sharply. The second right angled portion 27D integrates at another edge in common with the right front portion 27E. The right front portion 27E moves to the left horizontally and ends in a curve in common with a protrusion 27F. The left side of the protrusion 27F integrates along another common curve with a left front surface 27G that moves to the left horizontally. The left front surface 27G has a common edge with a second left angled portion 27H that moves upwards and to the right sharply ending at a common edge with the first left angled portion 27I. The first left angled portion 27I moves up and to left integrating with the left back surface 27A along a common edge. The backs 27A, 27B, 27C, 27D, 27E, 27G, 27H, 27I and a small internal support between the left front surface 27G and the right front surface 27E (behind protrusion 27F) enclose the hollow central region. The first left angled portion 27I and the first right angled portion 27C are utilized to attach two supports 22 one to each portion 27I, 27C near or at their respective tops. Barrel and screw 21 fasteners use this for attachment to arms therewith.

Figure 58D:
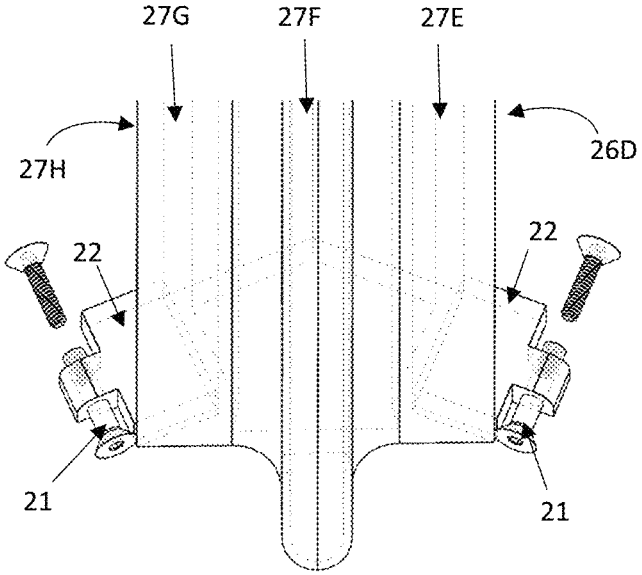
FIG. 58D presents a closeup bottom isometric view of a member 27 in a third embodiment disclosed herein.

FIG. 58D presents a closeup front bottom isometric view of a member 27 in a third embodiment disclosed herein. Again the first left angled portion 27I and the first right angled portion 27C are utilized to attach two supports 22 one to each portion 27I, 27C near or at their respective bottoms. Barrel and screw 21 fasteners use this for attachment to arms therewith.

Figure 59A:
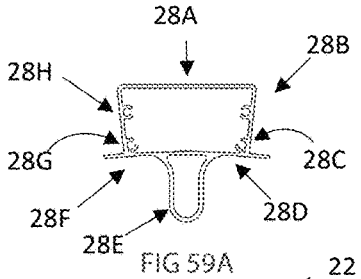
FIG. 59A presents a top view of a member 28 in a second embodiment disclosed herein.

FIG. 59A presents a top view of a member 28 in a second embodiment disclosed herein.

Figure 59B:
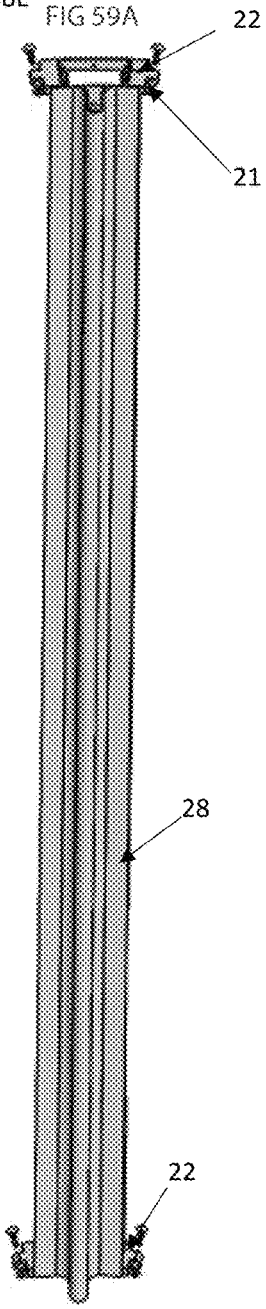
FIG. 59B presents an isometric view of a member 28 in a second embodiment disclosed herein.

FIG. 59B presents a front isometric view of a member 28 in a second embodiment disclosed herein. The member 28 has a top portion at left for welded attachment to a first support 22 and a top portion at right for welded attachment to a second support 22. The member 28 has a bottom portion at left for welded attachment to a third support 22 and a bottom portion at right for welded attachment to a fourth support 22. Supports 22 are used to attached various arms using barrel and screw fasteners 21.

Figure 59C:
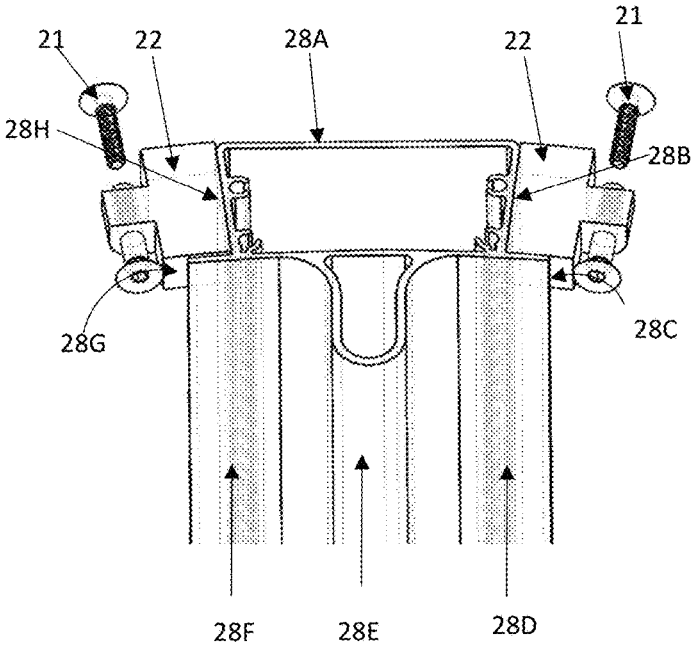
FIG. 59C presents a closeup top isometric view of a member 28 in a second embodiment disclosed herein.

FIG. 59C presents a closeup front top isometric view of a member 28 in a second embodiment disclosed herein. The member 28 has various contours running down its entire length unless otherwise specified. The member 28 has a hollow central region enclosed as follows; a back portion 28A moves to the right horizontally and integrates along a common edge with a right portion 28B. The right portion 28B moves down and to the left and integrates with a right flanged portion 28C; this right flanged portion 28C moves to the right horizontally and integrally serves as a rightmost part of a right front portion 28D. The right front portion 28D moves to the left and curves integrally into a protrusion 28E that juts forwards therefrom. The protrusion 28E integrates with a left front portion 28F along a curve therewith. The left front portion 28F moves to the left horizontally and has a left flanged portion 28G integrally formed therewith. The left flanged portion 28G has a back common edge with a left portion 28H. Finally, the left portion 28H integrates along a common edge with the back portion 28A. The backs of 28A, 28B, portion of 28D, portion of 28F, 28H, and a small internal support (behind protrusion 28E) between the left front surface 26F and the right front surface 28D enclose the hollow central region. The left portion 28H and the right portion 28B are utilized to attach two supports 22 one to each portion 28H, 28B near or at their respective tops. Barrel and screw 21 Fasteners use this for attachment to arms therewith.

Figure 59D:
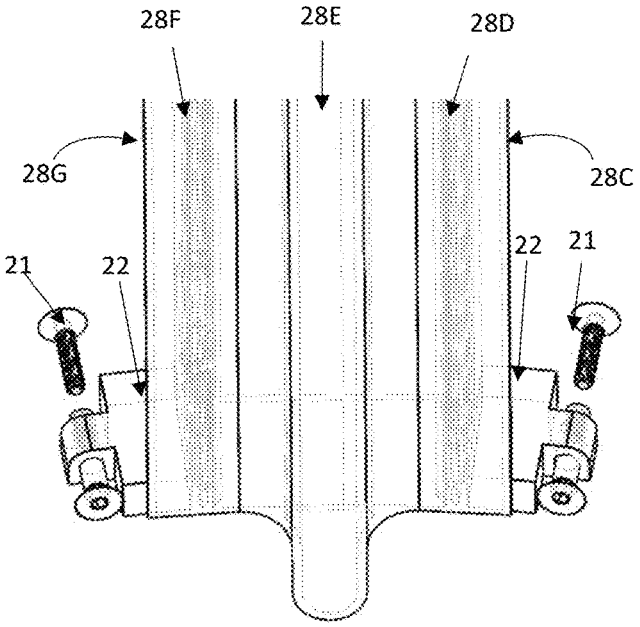
FIG. 59D presents a closeup bottom isometric view of a member 28 in a second embodiment disclosed herein.

FIG. 59D presents a closeup front bottom isometric view of a member 28 in a second embodiment disclosed herein. The left portion 28H and the right portion 28B are utilized to attach two supports 22 one to each portion 28H, 28B near or at their respective bottoms. Barrel and screw 21 Fasteners use this for attachment to arms therewith.

It should be apparent from the drawings described herein that the arms 24AA, 24BB, 24CC that act to fold the devices herein have a curved portion at their ends that face in a direction. Typically, when bending the top assemblies of any embodiment down the curved portions are disposed upwards at the arm and pivot attachments so that being curved the motion is facilitated. However, the arm to member connection (through support) is oppositely disposed, that is these connections have their curved portion disposed downwards to facilitate the folding operation thereof.

On the bottom folding assemblies of any embodiment, however, the situation is reversed. Typically, when bending the bottom assemblies upwards the arm and pivot attachment is curved downwards in these portions so that being so curved the motion is facilitated. However, in the bottom assemblies, the arm to member connection (through support) is oppositely disposed, that is these connections have their curved portion disposed upwards to facilitate the upwards folding operation thereof. In any case, these are the best dispositions for the curved portion of these connections, however, any reshaping of these ends of the arms, supports, pivot and so forth that facilitates these are also possible. The various member portions and surfaces are typically welded together from several portions or shaped that way using stamping, pressing and shaping machines.

The embodiments taught herein have a sequential folding wherein a first folding takes place in a first direction and then a second folding takes place in a second distinct direction different than the first direction; this such that each motion of the is not a radially nor centrally disposed step. In this regard, there are four adjacent member groups (1, 2, 3, 4) one between each adjacent member pair in a set of four members. Thus, a user folds a first group of two adjacent members and then a second group of two other adjacent members wherein the connection between adjacent members of the first group and adjacent members of the second group are not folded until after the first and second motion. The process can continue either by folding these two groups (1,2) to closure and then moving the other two adjacent member groups; or moving the other two (3, 4) adjacent member groups then further moving the first two groups and so on. Also, it should be apparent that the three embodiments herein described define a square, circular and octagonal configurations. Finally, the elevator structure described herein is typically used by a shaft or cylinder within which a cabin moves but may have other uses as well.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to a second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another;

wherein the first member further comprises: a forward protrusion and a rear edge lying on a centerline of the first member and disposed on opposing sides thereof; a left back portion integrates along the rear edge with a right back portion;

a first left angled portion integrates along a first common edge with the left back portion and extends closer to the centerline as it approaches the forward protrusion; the first left angled portion also integrates along its second edge common with a second left angled portion that extends away from the centerline and away from the forward protrusion; the second left angled portion has another edge in common with a left front surface; this left front surface extends towards the centerline and integrally curves into the forward protrusion;

this forward protrusion has an integral right front surface that curves away from it and away from the centerline; the right front surface integrates along a third common edge with a second right angled portion that angles towards the centerline and away from the forward protrusion; the second right angled portion has a fourth common edge with a first right angled portion that extends away from the centerline and away from the forward protrusion; the first right angled portion has a fifth common edge with the right back portion.

2. The foldable frame structure of claim 1, further comprising:

a third member attached to the second member using a third pivot and a fourth pivot; wherein the attachment between the third and second members uses two pairs of two arms, one pair of arms for each of the third pivot and the fourth pivot;

a fourth member attached to the third member using a fifth pivot and a sixth pivot, and the fourth member also attached to the first member using a seventh pivot and an eighth pivot;

wherein the attachment between the fourth and third members uses two pairs of two arms, one pair of arms for each of the fifth pivot and the sixth pivot; and wherein the attachment between the fourth and first members uses two pairs of two arms, one pair of arms for each of the seventh pivot and the eighth pivot;

such that the four members and pivots are generally disposed at an angle to one another which thereby facilitates the general shape of a square foldable frame structure.

3. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to a second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

wherein the first and second members each further comprise: a forward protrusion and a rear edge lying on a centerline of the first and second members and disposed on opposing sides thereof; a left back portion integrates along the rear edge with a right back portion; a first left angled portion integrates along a first common edge with the left back portion and extends closer to the centerline as it approaches the forward protrusion; the first left angled portion also integrates along its second edge common with a second left angled portion that extends away from the centerline and away from the forward protrusion; the second left angled portion has another edge in common with a left front surface; this left front surface extends towards the centerline and integrally curves into the forward protrusion;

this forward protrusion has an integral right front surface that curves away from it and away from the centerline; the right front surface integrates along a third common edge with a second right angled portion that angles towards the centerline and away from the forward protrusion; the second right angled portion has a fourth common edge with a first right angled portion that extends away from the centerline and away from the forward protrusion; the first right angled portion has a fifth common edge with the right back portion.

4. The foldable frame structure of claim 3, further comprising:

a fourth member attached to the third member using a fifth pivot and a sixth pivot, and the fourth member also attached to the first member using a seventh pivot and an eighth pivot;

wherein the attachment between the fourth and third members uses two pairs of two arms, one pair of arms for each of the fifth pivot and the sixth pivot; and wherein the attachment between the fourth and first members uses two pairs of two arms, one pair of arms for each of the seventh pivot and the eighth pivot;

such that the four members and pivots are generally disposed at an angle to one another which thereby facilitates the general shape of a square foldable frame structure.

5. A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot such that a third arm is movably attached to the first member and movably attached to a second pivot and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot; such that a ninth arm is movably attached to the third member and movably attached to the fifth pivot and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

wherein the first, second, and third members each further comprise: a forward protrusion and a rear edge lying on a centerline of the first, second, and third members and disposed on opposing sides thereof; a left back portion integrates along the rear edge with a right back portion; a first left angled portion integrates along a first common edge with the left back portion and extends closer to the centerline as it approaches the forward protrusion; the first left angled portion also integrates along its second edge common with a second left angled portion that extends away from the centerline and away from the forward protrusion; the second left angled portion has another edge in common with a left front surface; this left front surface extends towards the centerline and integrally curves into the forward protrusion;

this forward protrusion has an integral right front surface that curves away from it and away from the centerline; the right front surface integrates along a third common edge with a second right angled portion that angles towards the centerline and away from the forward protrusion; the second right angled portion has a fourth common edge with a first right angled portion that extends away from the centerline and away from the forward protrusion; the first right angled portion has a fifth common edge with the right back portion.

6. The foldable frame structure of claim 5, further comprising:

the fourth member also attached to the first member using a seventh pivot and an eighth pivot;

wherein the attachment between the fourth and first members uses two pairs of two arms, one pair of arms for each of the seventh pivot and the eighth pivot;

such that the four members and pivots are generally disposed at an angle to one another which thereby facilitates the general shape of a square foldable frame structure.

7. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to a second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that the spatial locations of these spaces are generally disposed at an angle to one another;

a third member movably attached to the second member through a third pivot such that a fifth arm is movably attached to the second member and movably attached to the third pivot; and such that a sixth arm is movably attached to the third member and movably attached to the third pivot;

wherein the third member is movably attached to the second member through a fourth pivot such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

the fourth member movably attached to the first member through a seventh pivot; such that a thirteenth arm is movably attached to the fourth member and movably attached to the seventh pivot and such that a fourteenth arm is movably attached to the first member and movably attached to the seventh pivot;

wherein the fourth member is movably attached to the first member through an eighth pivot; such that an fifteenth arm is movably attached to the fourth member and movably attached to the eighth pivot; and such that a sixteenth arm is movably attached to the first member and movably attached to the eight pivot;

wherein the fourth member has a seventh surface forming a seventh space for attaching the thirteenth arm thereto and the first member has an eighth surface forming an eighth space for attaching the fourteenth arm thereto, such that the spatial locations of these spaces are generally disposed at an angle to one another which thereby facilitates a general shape of the square foldable frame structure;

wherein the first, second, third and fourth member further each comprise: a forward protrusion and a rear edge lying on a centerline of the first member and on opposing sides thereof; a left back portion integrates along the rear edge with a right back portion; a first left angled portion integrates along a first common edge with the left back portion and extends closer to the centerline as it approaches the forward protrusion; the first left angled portion also integrates along its second edge common with a second left angled portion that extends away from the centerline and away from the forward protrusion; the second left angled portion has another edge in common with a left front surface; this left front surface extends towards the centerline and integrally curves into the forward protrusion;

this forward protrusion has an integral right front surface that curves away from it and away from the centerline; the right front surface integrates along a third common edge with a second right angled portion that angles towards the centerline and away from the forward protrusion; the second right angled portion has a fourth common edge with a first right angled portion that extends away from the centerline and away from the forward protrusion; the first right angled portion has a fifth common edge with the right back portion.

8. A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot; such that a third arm is movably attached to the first member and movably attached to a second pivot; and such that a fourth arm is movably attached to the second member and movably attached to the second pivot;

wherein the first member has a first surface forming a first space for attaching the first arm thereto and the second member has a second surface forming a second space for attaching the second arm thereto such that the spatial locations of these spaces are generally disposed at an angle to one another;

wherein the first member comprises: a back portion opposite a protrusion that is disposed away from a center of the first member; wherein the back portion integrates along a first common edge with a right portion; the right portion integrates with a right flanged portion; this right flanged portion extends away from the protrusion and the center of the first member and also integrally serves as a rightmost part of a right front portion;

the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

9. The foldable frame structure of claim 8, further comprising:

a third member attached to the second member using a third pivot and a fourth pivot;

wherein the attachment between the third and second members use two pairs of two arms, one pair of arms for each of the third pivot and the fourth pivot;

a fourth member attached to the third member using a fifth pivot and a sixth pivot, and the fourth member also attached to the first member using a seventh and an eighth pivot;

wherein the attachment between the fourth and third members uses two pairs of two arms, one pair of arms for each of the fifth pivot and the sixth pivot; and wherein the attachment between the fourth and first members uses two pairs of two arms, one pair of arms for each of the seventh pivot and the eighth pivot;

such that the four members and pivots are generally disposed at an angle to one another which thereby facilitates the general shape of a circular foldable frame structure.

10. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to the fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

wherein the first and second members each comprise: a back portion opposite a protrusion that is disposed away from a center of the respective member; wherein the back portion integrates along a first common edge with a right portion; the right portion integrates with a right flanged portion; this right flanged portion extends away from the protrusion and the center of the respective member and also integrally serves as a part of a right front portion; the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

11. The foldable frame structure of claim 10, further comprising:

a fourth member attached to the third member using a fifth pivot and a sixth pivot, and the fourth member also attached to the first member using a seventh pivot and an eighth; pivot;

wherein the attachment between the fourth and third members uses two pairs of two arms, one pair of arms for each of the fifth pivot and the sixth pivot; and wherein the attachment between the fourth and first members uses two pairs of two arms, one pair of arms for each of the seventh pivot and the eighth pivot;

such that the four members and pivots are generally disposed at an angle to one another which thereby facilitates the general shape of a circular foldable frame structure.

12. A foldable elevator structure comprising:

a first member movably attached to a second member through a first pivot; such that a first arm is movably attached to the first member and movably attached to the first pivot and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot; such that a fifth arm is movably attached to the second member and movably attached to the third pivot; and such that a sixth arm is movably attached to the third member and movably attached to the third pivot;

wherein the third member is movably attached to the second member through a fourth pivot such that a seventh arm is movably attached to the second member and movably attached to the fourth pivot and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot; such that a ninth arm is movably attached to the third member and movably attached to the fifth pivot and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

wherein the first, second and third members each comprise: a back portion opposite a protrusion that is disposed away from a center of the respective member; wherein the back portion integrates along a first common edge with a right portion 28B; the right portion integrates with a right flanged portion; this right flanged portion extends away from the protrusion and the center of the respective member and also integrally serves as a part of a right front portion; the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

13. The foldable frame structure of claim 12, further comprising:

the fourth member also attached to the first member using a seventh pivot and an eighth pivot;

wherein the attachment between the fourth and first members uses two pairs of two arms, one pair of arms for each of the seventh pivot and the eighth pivot;

such that the four members and pivots are generally disposed at an angle to one another which thereby facilitates the general shape of a circular foldable frame structure.

14. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot; such that a fifth arm is movably attached to the second member and movably attached to the third pivot and such that a sixth arm is movably attached to the third member and movably attached to the third pivot;

wherein the third member is movably attached to the second member through a fourth pivot such that a seventh arm is movably attached to the second member and movably attached to the fourth pivot and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot; such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

the fourth member movably attached to the first member through a seventh pivot; such that a thirteenth arm is movably attached to the fourth member and movably attached to the seventh pivot and such that a fourteenth arm is movably attached to the first member and movably attached to the seventh pivot;

wherein the fourth member is movably attached to the first member through an eighth pivot; such that a fifteenth arm is movably attached to the fourth member and movably attached to the eighth pivot and such that a sixteenth arm is movably attached to the first member and movably attached to the eight pivot;

wherein the fourth member has a seventh surface forming a seventh space for attaching the thirteenth arm thereto and the first member has an eighth surface forming an eighth space for attaching the fourteenth arm thereto, such that the spatial locations of these spaces are generally disposed at an angle to one another which thereby facilitates a general shape of a circular foldable frame structure;

wherein the first, second, third and fourth members each comprise: a back portion opposite a protrusion that is disposed away from a center of the respective member; wherein the back portion integrates along a first common edge with a right portion; the right portion integrates with a right flanged portion; this right flanged portion extends away from the protrusion and the center of the respective member and also integrally serves as a rightmost part of a right front portion;

the right front portion curves integrally into the protrusion; the protrusion integrates with a left front portion along a curve therewith; the left front portion has a left flanged portion integrally formed therewith; the left flanged portion has a back common edge with a left portion; the left portion integrates along a second common edge with the back portion.

15. A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another; wherein the first pivot further comprises:

a flat bottom and a flat top surface as well as a left protrusion and a right protrusion disposed at opposing ends of the first pivot and situated at an angle there between;

a rear surface has a triangular or arrow head shape with a top of the triangular or arrow head shape extending outwards from a center of the first pivot; the rear surface integrates with a left small flat surface and a right small flat surface; the right small flat surface then integrates with an edge of the right protrusion; this right protrusion has a hole passing there through for attachment of the first arm;

another edge of the right protrusion integrates with another right small flat surface that in turn integrates with an edge of a three-faceted surface is recessed towards the center of the first pivot; another edge of the three faceted surface integrates with another left small flat surface that integrates with an edge of the left protrusion; this left protrusion has a hole passing there through for attachment of the second arm; another edge of the left protrusion integrates with the left small flat surface that in turn integrates with an edge of the rear surface.

16. The foldable frame structure of claim 15, further comprising:

a third member attached to the second member using a third pivot and fourth pivot;

wherein the attachment between the third and second members use two pairs of two arms, one pair of arms for each of the third pivot and the fourth pivot;

a fourth member attached to the third member using a fifth pivot and a sixth pivot, and the fourth member also attached to the first member using a seventh pivot and an eighth pivot;

wherein the attachment between the fourth and third members uses two pairs of two arms, one pair of arms for each of the fifth pivot and the sixth pivot; and wherein the attachment between the fourth and first members uses two pairs of two arms, one pair of arms for each of the seventh pivot and the eighth pivot;

such that the four members and pivots are generally disposed at an angle to one another which thereby facilitates the general shape of an octagonal foldable frame structure.

17. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another; wherein the first and second members each further comprising:

the first and second members each has a protrusion and a common edge positioned on opposite sides of the respective member; the protrusion and the common edge defines a center plane that extends along a longitudinal center of the member; a left back portion and a right back portion extends away from the common edge towards the protrusion; the right back portion integrates with a first right angled portion; the first right angled portion extends towards the protrusion and towards the center plane and integrates with a second right angled portion; the second right angled portion extends away from the center plane, and the protrusion;

the second right angled portion integrates at another edge in common with a right front portion; the right front portion-a ends in a curve in common with the protrusion; the protrusion integrates along another common curve with a left front portion; the left front portion has a third common edge with a second left angled portion that extends toward the center plane and away from the protrusion ending at a fourth common edge with a first left angled portion; the first left angled portion extends away from the center plane and protrusion and integrates with the left back portion along a fifth common edge.

18. The foldable frame structure of claim 17, further comprising:

a third member attached to the second member using a third pivot and a fourth pivot; wherein the attachment between the third and second members use two pairs of two arms, one pair of arms for each of the third pivot and the fourth pivot;

a fourth member attached to the third member using a fifth pivot and a sixth pivot, and the fourth member also attached to the first member using a seventh pivot and an eighth pivot;

wherein the attachment between the fourth and third members uses two pairs of two arms, one pair of arms for each of the fifth pivot and the sixth pivot; and wherein the attachment between the fourth and first members uses two pairs of two arms, one pair of arms for each of the seventh pivot and the eighth pivot;

such that the four members and pivots are generally disposed at an angle to one another which thereby facilitates the general shape of an octagonal foldable frame structure.

19. A foldable elevator structure comprising:

a first member movably attached to a second member through a first pivot such that a first arm is movably attached to the first member and movably attached to the first pivot; and such that a second arm is movably attached to the second member and movably attached to the first pivot;

wherein the first member is movably attached to the second member through a second pivot; such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another; wherein the first, second and third members further comprising:

the first, second, and third members each has a protrusion and a common edge positioned on opposite sides respective member; the protrusion and the common edge defines a center plane that extends along a longitudinal center of the member; a left back portion and a right back portion extends away from the common edge towards the protrusion; the right back portion integrates with a first right angled portion; the first right angled portion extends towards the protrusion and towards the center plane and integrates with a second right angled portion; the second right angled portion extends away from the center plane and the protrusion;

the second right angled portion integrates at another edge in common with a right front portion; the right front portion ends in a curve in common with the protrusion; the protrusion integrates along another common curve with a left front portion; the left front portion has a third common edge with a second left angled portion that extends toward the center plane and away from the protrusion ending at a fourth common edge with a first left angled portion; the first left angled portion extends away from the center plane and protrusion and integrates with the left back portion along a fifth common edge.

20. The foldable frame structure of claim 19, further comprising:

a fourth member attached to the third member using a fifth pivot and a sixth pivot, and the fourth member also attached to the first member using a seventh pivot and an eighth pivot;

wherein the attachment between the fourth and third members uses two pairs of two arms, one pair of arms for each of the fifth pivot and the sixth pivot;

wherein the attachment between the fourth and first members uses two pairs of two arms, one pair of arms for each of the seventh pivot and the eighth pivot;

such that the four members and pivots are generally disposed at an angle to one another which thereby facilitates the general shape of an octagonal foldable frame structure.

21. A foldable elevator structure comprising:

a first member movably attached to a second member through a first pivot; such that a first arm is movably attached to the first member and movably attached to the first pivot; and such that a second arm is movably attached to the second member and movably attached to the first pivot;

wherein the first member is movably attached to the second member through a second pivot such that a third arm is movably attached to the first member and movably attached to the second pivot; and such that a fourth arm is movably attached to the second member and movably attached to the second pivot;

wherein the first member has a first surface forming a first space for attaching the first arm thereto and the second member has a second surface forming a second space for attaching the second arm thereto, such that spatial locations of these spaces are generally disposed at an angle to one another;

a third member movably attached to the second member through a third pivot such that a fifth arm is movably attached to the second member and movably attached to the third pivot; and such that a sixth arm is movably attached to the third member and movably attached to the third pivot;

wherein the third member is movably attached to the second member through a fourth pivot; such that a seventh arm is movably attached to the second member and movably attached to a fourth pivot; and such that an eighth arm is movably attached to the third member and movably attached to the fourth pivot;

wherein the second member has a third surface forming a third space for attaching the fifth arm thereto and the third member has a fourth surface forming a fourth space for attaching the sixth arm thereto, such that the spatial locations of these spaces are generally disposed at an angle to one another;

a fourth member movably attached to the third member through a fifth pivot such that a ninth arm is movably attached to the third member and movably attached to the fifth pivot; and such that a tenth arm is movably attached to the fourth member and movably attached to the fifth pivot;

wherein the fourth member is movably attached to the third member through a sixth pivot; such that an eleventh arm is movably attached to the third member and movably attached to the sixth pivot; and such that a twelfth arm is movably attached to the fourth member and movably attached to the sixth pivot;

wherein the third member has a fifth surface forming a fifth space for attaching the ninth arm thereto and the fourth member has a sixth surface forming a sixth space for attaching the tenth arm thereto, such that the spatial locations of these spaces are generally disposed at an angle to one another;

the fourth member movably attached to the first member through a seventh pivot; such that a thirteenth arm is movably attached to the fourth member and movably attached to the seventh pivot and such that a fourteenth arm is movably attached to the first member and movably attached to the seventh pivot;

wherein the fourth member is movably attached to the first member through an eighth pivot; such that a fifteenth arm is movably attached to the fourth member and movably attached to the eighth pivot; and such that a sixteenth arm is movably attached to the first member and movably attached to the eight pivot;

wherein the fourth member has a seventh surface forming a seventh space for attaching the thirteenth arm thereto and the first member has an eighth surface forming an eighth space for attaching the fourteenth arm thereto, such that the spatial locations of these spaces are generally disposed at an angle to one another which thereby facilitates a general shape of the octagonal foldable frame structure; wherein the first, second, third and fourth members each further comprise:

the first, second, third, and fourth members each has a protrusion and a common edge positioned on opposite sides of the respective member; the protrusion and the common edge defines a center plane that extends along a longitudinal center of the member; a left back portion and a right back portion extends away from the common edge towards the protrusion; the right back portion integrates with a first right angled portion; the first right angled portion extends towards the protrusion and towards the center plane and integrates with a second right angled portion; the second right angled portion extends away from the center plane and the protrusion;

the second right angled portion integrates at another edge in common with a right front portion; the right front portion ends in a curve in common with the protrusion; the protrusion integrates along another common curve with a left front portion; the left front portion has a third common edge with a second left angled portion that extends toward the center plane and away from the protrusion ending at a fourth common edge with a first left angled portion; the first left angled portion extends away from the center plane and protrusion and integrates with the left back portion along a fifth common edge.

* * * * *